US006070662A

United States Patent [19]

Ciglenec et al.

[11] Patent Number: 6,070,662

[45] Date of Patent: Jun. 6, 2000

[54] FORMATION PRESSURE MEASUREMENT WITH REMOTE SENSORS IN CASED BOREHOLES

[75] Inventors: Reinhart Ciglenec; Jacques R. Tabanou, both of Houston, Tex.

[73] Assignee: Schlumberger Technology Corporation, Sugar land, Tex.

[21] Appl. No.: 09/135,774

[22] Filed: Aug. 18, 1998

[51] Int. Cl.[7] ..... E21B 47/00

[52] U.S. Cl. ..... 166/254.1; 166/66; 166/113; 166/177.6; 340/854.5; 367/82

[58] Field of Search ..... 166/254.1, 250.01, 166/53, 65.1, 66, 113, 177.2, 177.6; 340/854.5; 367/82

[56] References Cited

U.S. PATENT DOCUMENTS

| | | | |
|---|---|---|---|
| 3,528,000 | 9/1970 | Schwede . | |
| 3,934,468 | 1/1976 | Brieger . | |
| 4,651,100 | 3/1987 | Janes . | |
| 4,860,581 | 8/1989 | Zimmerman et al. . | |
| 4,893,505 | 1/1990 | Marsden et al. . | |
| 4,936,139 | 6/1990 | Zimmerman et al. . | |
| 5,065,619 | 11/1991 | Myska . | |
| 5,165,274 | 11/1992 | Thiercelin . | |
| 5,195,588 | 3/1993 | Dave . | |
| 5,622,223 | 4/1997 | Vasquez . | |
| 5,687,806 | 11/1997 | Sallwasser et al. . | |
| 5,692,565 | 12/1997 | MacDougall et al. . | |
| 5,765,637 | 6/1998 | Dietle et al. . | |
| 5,810,083 | 9/1998 | Kilgore | 166/120 |
| 6,021,095 | 2/2000 | Tubel et al. | 166/166 X |

*Primary Examiner*—Roger Schoeppel
*Attorney, Agent, or Firm*—Steven L. Christian

[57] ABSTRACT

The present invention relates to a method and apparatus for establishing communication in a cased wellbore with a data sensor that has been remotely deployed, prior to the installation of casing in the wellbore, into a subsurface formation penetrated by the wellbore. Communication is established by installing an antenna in an opening in the casing wall. The present invention further relates to a method and apparatus for creating the casing wall opening, and then inserting the antenna in the opening in sealed relation with the casing wall. A data receiver is inserted into the cased wellbore for communicating with the data sensor via the antenna to receive formation data signals sensed and transmitted by the data sensor. Preferably, the location of the data sensor in the subsurface formation is identified prior to the installation of the antenna, so that the opening in the casing can be created proximate the data sensor. The antenna can then be installed in the casing wall opening for optimum communication with the data sensor. It is also preferred that the data sensor be equipped with means for transmitting a signature signal, permitting the location of the data sensor to be identified by sensing the signature signal. The location of the data sensor is identified by first determining the depth of the data sensor, and then determining the azimuth of the data sensor relative to the wellbore.

42 Claims, 14 Drawing Sheets

FORMATION PRESSURE MEASUREMENT WITH REMOTE SENSORS IN CASED BOREHOLES

CROSS-REFERENCE TO RELATED APPLICATIONS

BACKGROUND OF THE INVENTION

1. Field of the Invention

This invention relates generally to the determination of various parameters in a subsurface formation penetrated by a wellbore, and, more particularly, to such determination after casing has been installed in the wellbore by way of communication across the wall of the casing with remote sensors deployed into the formation prior to the installation of the casing.

2. Description of the Related Art

Present day oil well operation and production involves continuous monitoring of various well parameters. One of the most critical parameters required to ensure steady production is reservoir pressure, also know as formation pressure. Continuous monitoring of parameters such as reservoir pressure indicate the formation pressure change over a period of time, and is necessary to predict the production capacity and lifetime of a subsurface formation. Typically, formation parameters, including pressure, are monitored with wireline formation testing tools, such as those tools described in U.S. Pat. Nos. 3,934,468; 4,860,581; 4,893,505; 4,936,139; and 5,622,223.

The '468 patent, assigned to Schlumberger Technology Corporation, the assignee of the present invention, describes an elongated tubular body that is disposed in an uncased wellbore to test a formation zone of interest. The tubular body has a sealing pad which is urged into sealing engagement with the wellbore at the formation zone by secondary well-engaging pads opposite the sealing pad and a series of hydraulic actuators. The body is equipped with a fluid admitting means, including a movable probe, that communicates with and obtains samples of formation fluids through a central opening in the sealing pad. Such fluid communication and sampling permits the collection of formation parameter data, including but not limited to formation pressure. The movable probe of the '468 patent is particularly adapted for testing formation zones exhibiting different and unknown competencies or stabilities.

The '581 and '139 patents, also assigned to the assignee of the present invention, disclose modular formation testing tools that provide numerous capabilites, including formation pressure measurement and sampling, in uncased wellbores. These patents describe tools that are capable of taking measurements and samples at multiple formation zones in a single trip of the tool.

The '505 patent, assigned to Western Atlas International, Inc., similarly discloses a formation testing tool capable of measuring the pressure and temperature of the formation penetrated by an uncased wellbore, as well as collecting fluid samples, at a plurality of formation zones.

The '223 patent, assigned to Halliburton Company, discloses another wireline formation testing tool for withdrawing a formation fluid from a zone of interest in an uncased wellbore. The tool utilizes an inflatable packer, and is said to be operable for determining in situ the type and the bubble point pressure of the fluid being withdrawn, and for selectively collecting fluid samples that are substantially free of mud filtrates.

Each of the aforementioned patents is limited in that the formation testing tools described therein are only capable of acquiring formation data as long as the tools are disposed in the wellbore and in physical contact with the formation zone of interest.

U.S. patent application Ser. No. 09/019,466, also assigned to the assignee of the present invention, describes a method and apparatus for deploying intelligent data sensors, such as pressure sensors, from a drill collar in the drill string into the subsurface formation beyond the wellbore while drilling operations are being performed. The positioning of such data sensors during the drilling phase of an oil well is accomplished by means of either shooting, drilling, hydraulically forcing, or otherwise deploying the sensors into the formation, as described in the '466 application which is incorporated by reference herein in its entirety.

The '466 application further discloses the use of means for identifying the location of such data sensors long after deployment, particularly through the use of gamma-ray pip-tags in the sensors. These gamma-ray pip-tags emit distinct radioactive "signatures" that are easily contrasted to the gamma-ray background profiles or signatures of the local respective subsurface formation, and thereby facilitate a determination of each sensor's location in the formation.

At some stage during the completion phase of the well, a string of casing will be installed in the wellbore. After the wellbore has been lined with casing and the casing has been cemented, if necessary, standard electromagnetic communication from inside the wellbore with the individual remote sensors outside the casing is no longer possible. If there is no effective means of communicating with a data sensor which has been embedded beyond the cased wellbore in the formation, the data sensor has no utility. Thus, for the remote data sensor(s) to provide continuous formation monitoring capabilities during the productive life of the wellbore, communication with the data sensors must be reestablished. Furthermore, for the communication with the data sensor(s) to be optimized, the location of the sensors must be identified after the wellbore has been cased and cemented.

The tools and methods described in the '468, '581, '139, '505, and '223 patents mentioned above are not intended for use in cased wellbores, and are generally not permanently connected to the wellbore or formation. However, formation testing tools and methods that are intended for use in cased wellbores are well known in the art, as exemplified by U.S. Pat. Nos. 5,065,619; 5,195,588; and 5,692,565.

The '619 patent, assigned to Halliburton Logging Services, Inc., discloses a means for testing the pressure of a formation behind casing in a wellbore that penetrates the formation. A "backup shoe" is hydraulically extended from one side of a wireline formation tester for contacting the casing wall, and a testing probe is hydraulically extended from the other side of the tester. The probe includes a surrounding seal ring which forms a seal against the casing wall opposite the backup shoe. A small shaped charge is positioned in the center of the seal ring for perforating the casing and surrounding cement layer, if present. Formation fluid flows through the perforation and seal ring into a flow line for delivery to a pressure sensor and a pair of fluid manipulating and sampling tanks.

The '588 patent, also assigned to the assignee of the present invention, improves upon the formation testers that perforate the casing to obtain access to the formation behind the casing by providing a means for plugging the casing perforation. More specifically, the '588 patent discloses a tool that is capable of plugging a perforation while the tool is still set at the position at which the perforation was made. Timely closing of the perforation(s) by plugging prevents the possibility of substantial loss of wellbore fluid into the formation and/or degradation of the formation. It also prevents the uncontrolled entry of formation fluids into the wellbore, which can be deleterious such as in the case of gas intrusion.

The '565 patent, also assigned to Schlumberger Technology Corporation, describes a further improved apparatus and method for sampling a formation behind a cased wellbore, in that the invention uses a flexible drilling shaft to create a more uniform casing perforation than with a shaped charge. The uniform perforation provides greater reliability that the casing will be properly plugged, because shaped charges result in non-uniform perforations that can be difficult to plug, often requiring both a solid plug and a non-solid sealant material. Thus, the uniform perforation provided by the flexible drilling shaft increases the reliability of using plugs to seal the casing. Once the casing perforations are plugged, however, there is no means of communicating with the formation without repeating the perforation process. Even then, such formation communication is possible only as long as the formation tester is set in the wellbore and the casing perforation remains open.

To address the problems and shortcomings of the related art, it is a principal object of the present invention to provide a method and apparatus for reestablishing communication with remotely deployed data sensors across the casing wall and cement layer of a cased wellbore.

It is a further object to provide a method and apparatus for determining the location of each such data sensor in the subsurface formation relative to the casing wall.

It is a further object to provide a method and apparatus for creating an opening in the casing wall and cement layer that line a cased wellbore proximate the location of a data sensor or group of data sensors.

It is a further object to provide a method and apparatus for installing an antenna in the created opening in sealed relation with the casing wall for communicating with the remote data sensor or sensors.

It is a still further object to provide a method and apparatus for transmitting command signals to the remote data sensors and receiving data signals from the remote data sensors via the installed antenna to monitor the wellbore.

It is a still further object to provide a data receiver that utilizes a microwave cavity and is positionable within the wellbore to communicate with the remote data sensor(s) via the installed antenna(s).

SUMMARY OF THE INVENTION

The objects described above, as well as other various objects and advantages, are achieved by a method and apparatus that permit communication, after casing has been installed in a wellbore, with a data sensor that has been remotely deployed into a subsurface formation penetrated by the wellbore prior to the installation of casing at the deployed depth. Communication is established by installing an antenna in the casing wall, and then inserting a data receiver into the cased wellbore for communicating with the data sensor via the antenna to receive formation data signals sensed and transmitted by the data sensor.

In a preferred embodiment of the present invention, the location of the data sensor in the subsurface formation is identified prior to the installation of the antenna, so that the antenna can be installed in an opening in the casing wall proximate the data sensor location. It is also preferred that the data sensor be equipped with means for transmitting a signature signal, permitting the location of the data sensor to be identified by sensing the signature signal. In this regard, the data sensor is preferably equipped with a gamma-ray pip-tag for transmitting a pip-tag signature signal. The location of the data sensor is identified by first creating a gamma-ray open hole log of the wellbore, then determining the depth of the data sensor using the gamma-ray open hole log and the pip-tag signature signal of the data sensor, and then determining the azimuth of the data sensor relative to the wellbore using a gamma-ray detector and the pip-tag signature signal. The azimuth is preferably determined using a collimated gamma-ray detector.

The antenna is preferably installed and sealed in an opening in the casing using a wireline tool. The wireline tool includes means for identifying the azimuth of the data sensor relative to the wellbore, means for rotating the tool to the identified azimuth, means for drilling or otherwise creating an opening through the casing and cement at the identified azimuth, and means for installing the antenna into the opening in sealed relation with the casing.

The data receiver is preferably inserted into the cased wellbore on a wireline, and includes a microwave cavity.

In another aspect, the present invention contemplates the drilling of a wellbore with a drill string having a drill collar and a drill bit. The drill collar has a data sensor adapted for remote positioning within a selected subsurface formation intersected by the wellbore to sense and transmit data signals representative of various parameters of the formation. Before the wellbore is completely cased, the data sensor is moved from the drill collar into the selected subsurface formation. After the casing has been installed in the wellbore, an antenna is installed in an opening formed in the casing wall. A data receiver is subsequently inserted into the cased wellbore for communicating with the data sensor via the antenna to receive formation data signals sensed and transmitted by the data sensor.

In another aspect, the present invention contemplates the use of a drill collar that includes a tool having sensing means movable from a retracted position within the tool to a deployed position within the subsurface earth formation beyond the wellbore. The sensing means has electronic circuitry therein adapted to sense selected formation parameters and provide data output signals representing the sensed formation parameters. When the drill collar and tool are positioned at a desired location relative to a subsurface formation of interest, the sensing means is moved from a retracted position within the tool to a deployed position within the subsurface formation of interest remote from the collar and outwardly of the wellbore. After casing has been installed in the wellbore, the location of the data sensor in the subsurface formation is identified and an antenna is installed in a lateral opening through the casing wall in sealed relation with the casing proximate the data sensor location. A receiving means is then inserted into the cased wellbore and the electronic circuitry of the sensing means is electronically activated, causing the sensing means to sense the selected formation parameters and transmit data signals representative of the sensed formation parameters. The transmitted data signals are then received with the receiving means.

In yet another aspect, the present invention includes a drill collar adapted for connection in a drill string and having a sensor receptacle. A remote intelligent sensor is located within the sensor receptacle of the drill collar and has electronic circuitry for sensing selected formation data, for receiving command signals, and for transmitting data signals representative of the sensed formation data. The remote intelligent sensor is adapted for lateral deployment from the sensor receptacle to a location within the subsurface formation beyond the wellbore. An antenna for communicating with the remote intelligent sensor is carried, following the installation of casing in the wellbore, with means also adapted for creating an opening in the casing wall proximate the remote intelligent sensor and for inserting the antenna into the created opening in sealed relation with the casing wall. A data receiver adapted for insertion into the wellbore and having electronic circuitry for transmitting command signals via the antenna after installation of the antenna and for receiving formation data signals via the antenna from the remote intelligent sensor is also provided.

Preferably, the transmitting and receiving circuitry of the data receiver is adapted for transmitting command signals at a frequency F and for receiving data signals at a frequency 2F, and the receiving and transmitting circuitry of the remote intelligent sensor is adapted for receiving command signals at a frequency F and for transmitting data signals at a frequency 2F.

Preferably, the remote intelligent sensor includes an electronic memory circuit for acquiring formation data over a period of time. The data sensing circuitry of the remote intelligent sensor preferably includes means for inputting formation data into the electronic memory circuit, and a coil control circuit for receiving the output of the electronic memory circuit and activating the receiving and transmitting circuitry of the remote intelligent sensor to transmit signals representative of the sensed formation data from the deployed location of the remote intelligent sensor to the transmitting and receiving circuitry of the data receiver.

BRIEF DESCRIPTION OF THE DRAWINGS

So that the manner in which the above recited objects and advantages of the present invention are attained and can be understood in detail, a more particular description of the invention, briefly summarized above, may be had by reference to the preferred embodiment thereof which is illustrated in the appended drawings, which drawings are incorporated as a part of this specification.

It is to be noted however, that the appended drawings illustrate only a typical embodiment of this invention and are therefore not to be considered limiting of its scope, for the invention may admit to other equally effective embodiments.

In the drawings:

FIG. 1 is an elevational view of a drill string section in a wellbore, showing a drill collar and a remotely positioned data sensor which has been deployed from the drill collar into a subsurface formation of interest;

FIG. 2 is a sectional view of the subsurface formation after casing has been installed in the wellbore, with an antenna installed in an opening through the wall of the casing and cement layer in close proximity to the remotely deployed data sensor;

FIG. 3 is a schematic of a wireline tool positioned within the casing and having upper and lower rotation tools and an intermediate antenna installation tool;

FIG. 4 is a schematic of the lower rotation tool taken along section line 4—4 in FIG. 3;

FIG. 5 is a lateral radiation profile taken at a selected wellbore depth to contrast the gamma-ray signature of a data sensor pip-tag with the subsurface formation background gamma-ray signature;

FIG. 6 is a sectional schematic of a tool for creating a perforation in the casing and installing an antenna in the perforation for communication with the data sensor;

FIG. 6A is one of a pair of guide plates utilized in the antenna installation tool for conveying a flexible shaft which is used to perforate the casing;

FIG. 7 is a flow chart of the operational sequence for the tool shown in FIG. 6;

FIG. 8 is a sectional view of an alternative tool for perforating casing;

FIGS. 9A–9C are sequential sectional views showing the installation of one embodiment of the antenna in the casing perforation;

FIG. 9D is a sectional view of a second embodiment of the antenna installed in the casing perforation;

Figure 9A:
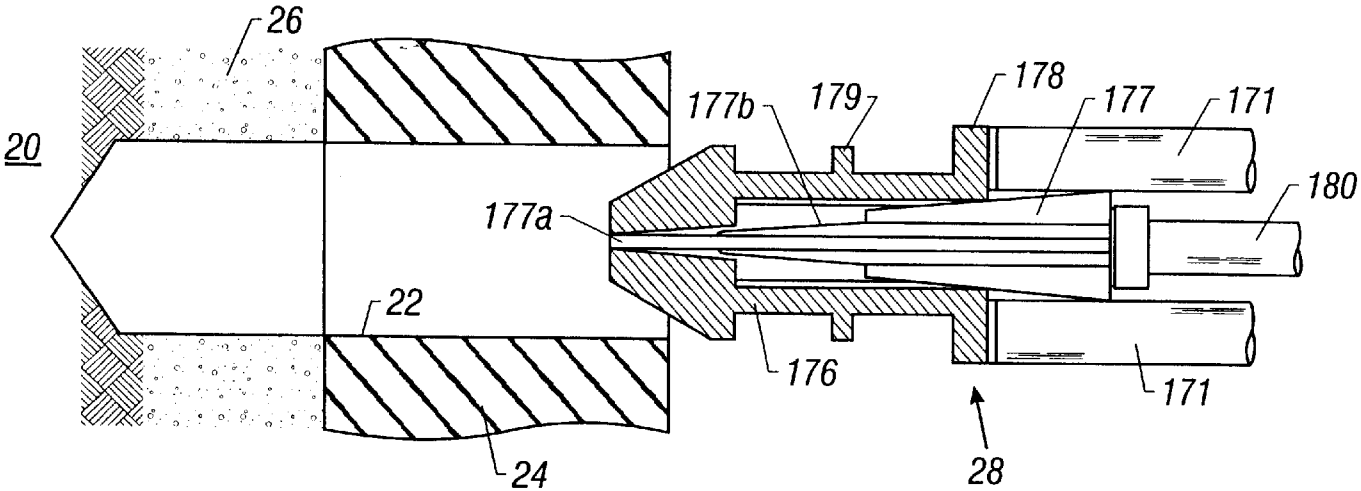
Figure 9B:
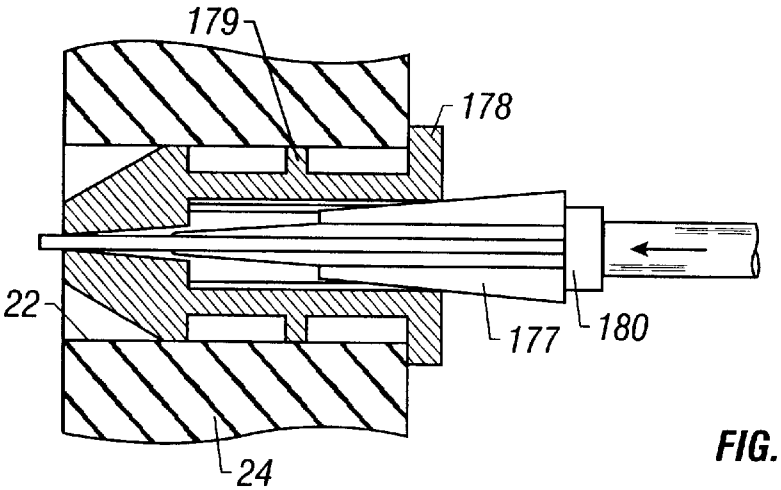
Figure 9C:
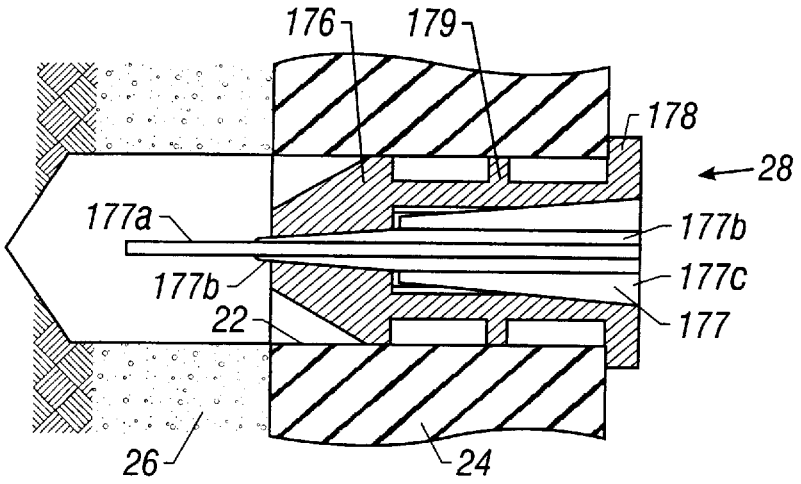
Figure 10:
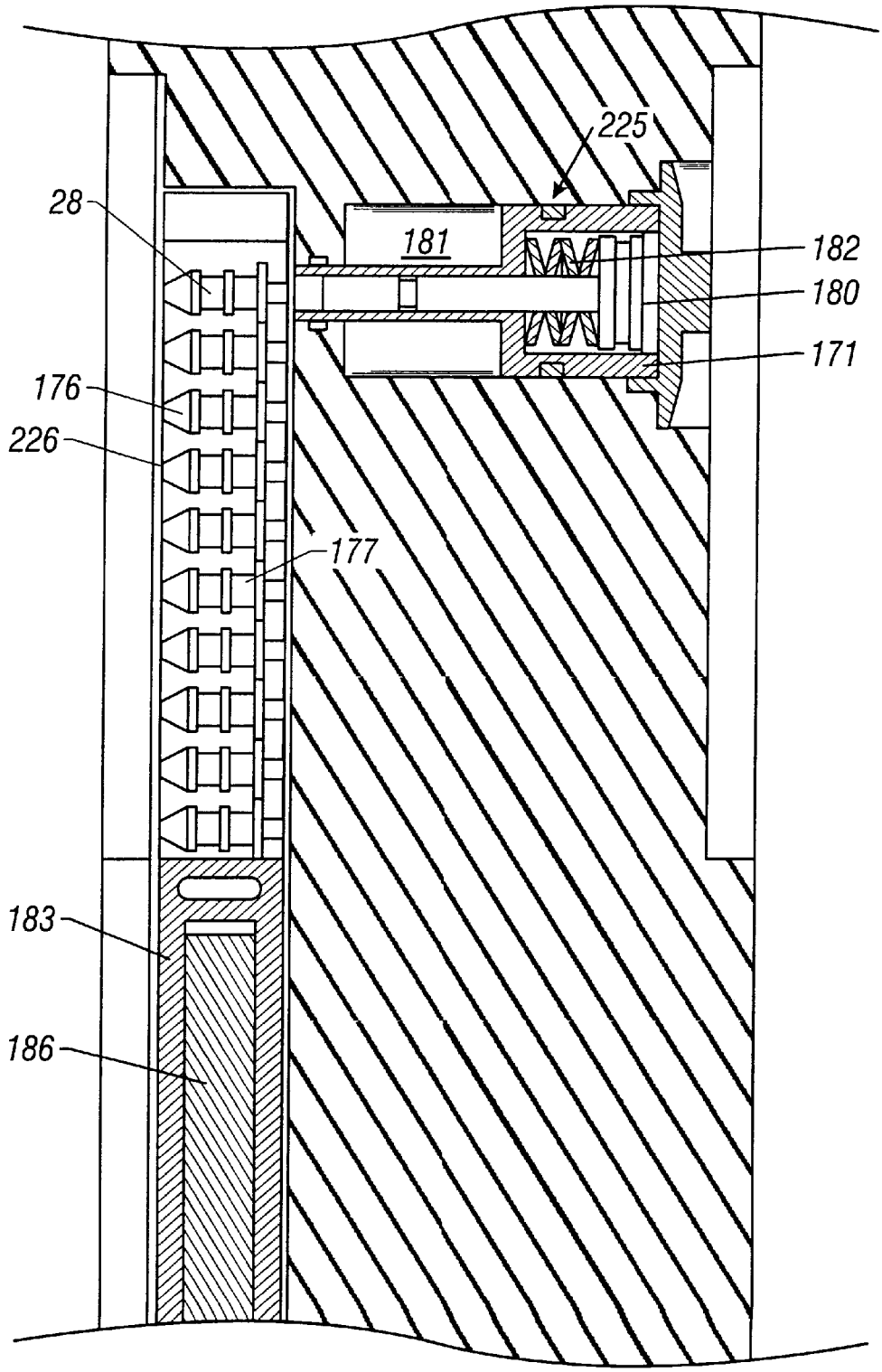
Figure 11:
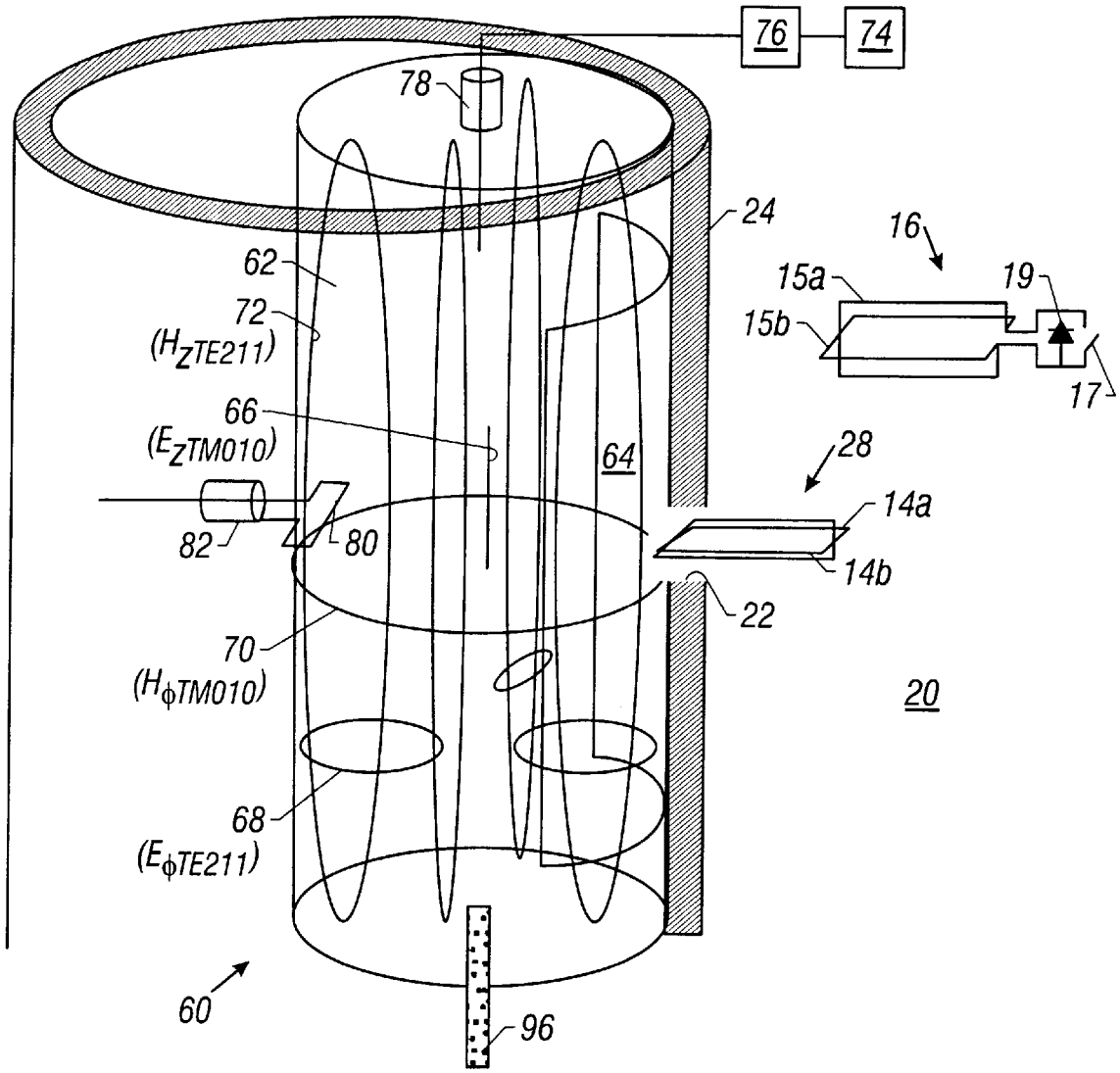
Figure 12:
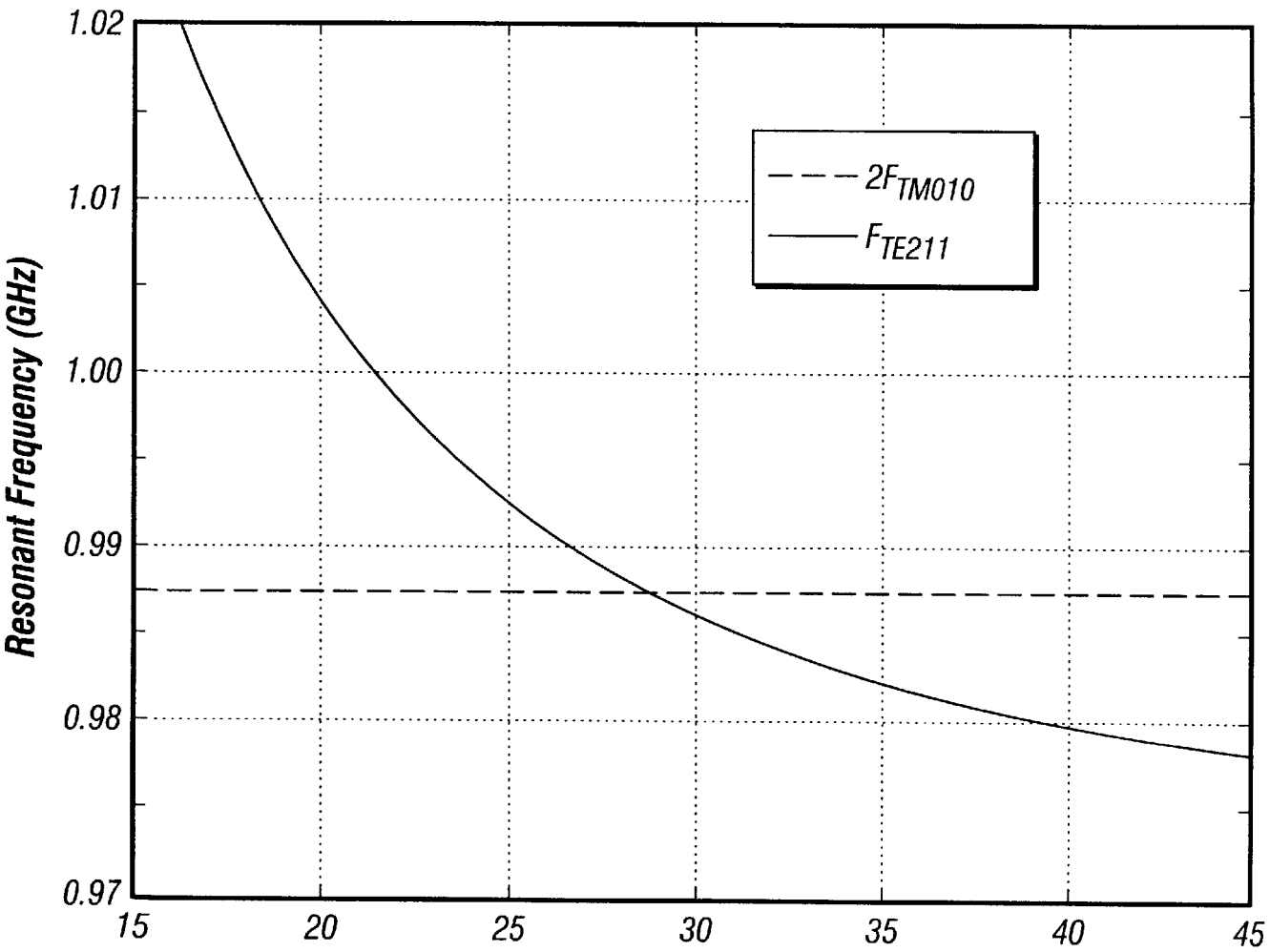
Figure 13:
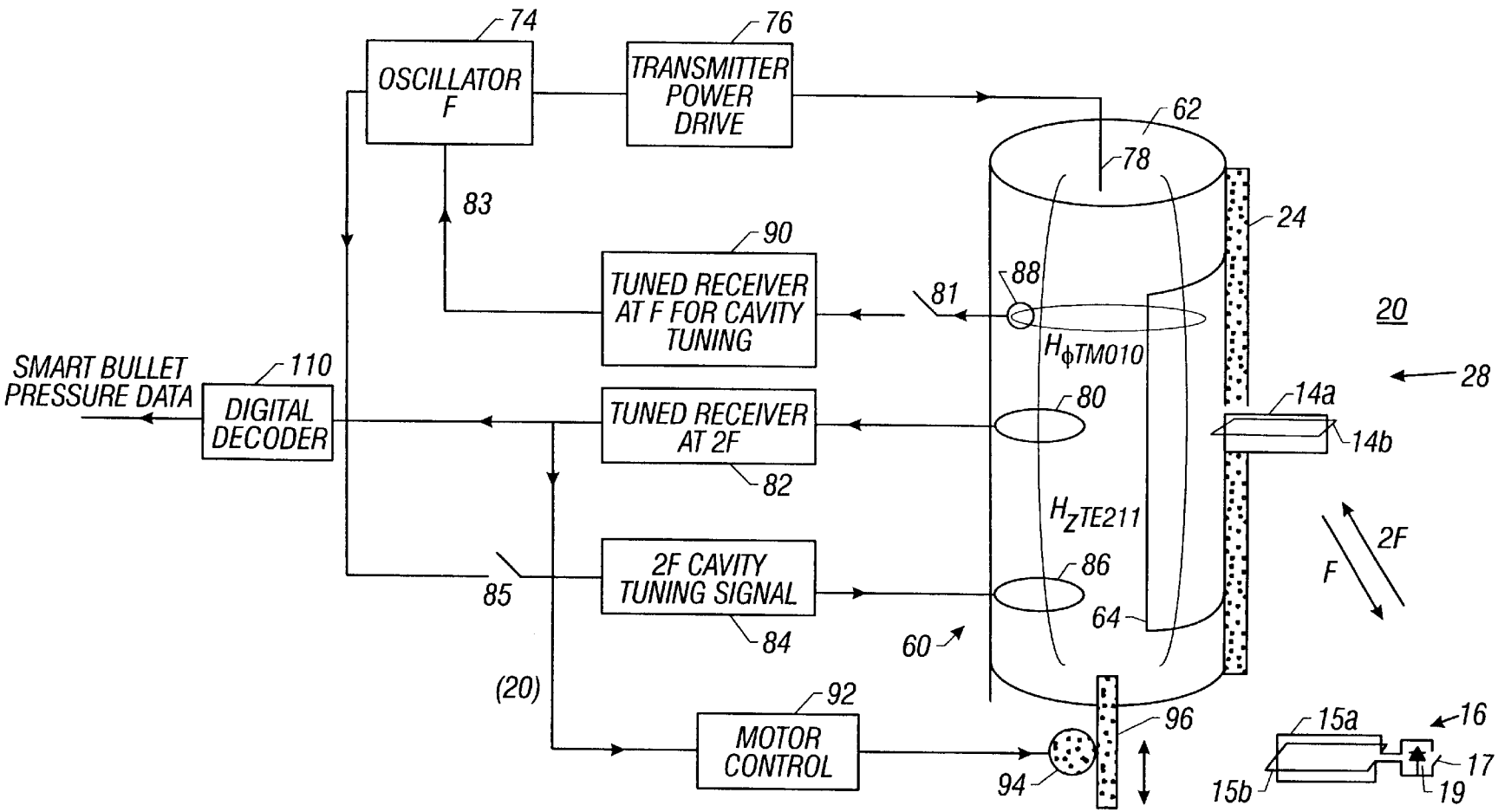
Figure 14:
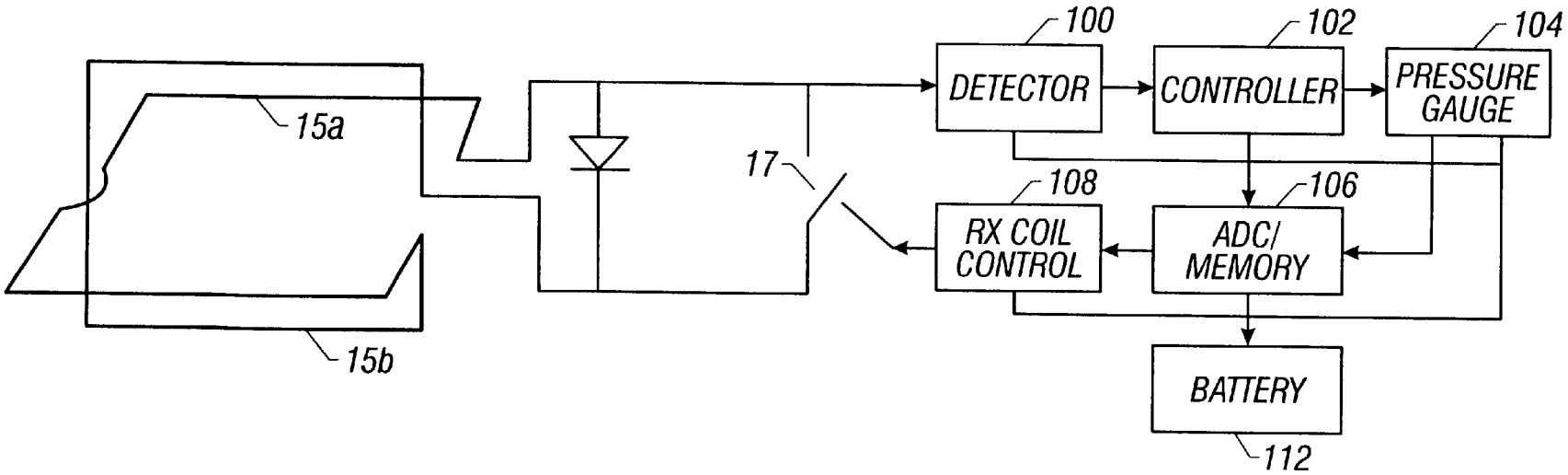

FIG. 10 is a detailed sectional view of the lower portion of the antenna installation tool, particularly the antenna magazine and installation mechanism for the antenna embodiment shown in FIGS. 9A–9C;

FIG. 11 is a schematic of the data receiver positioned within the casing for communication with the remotely deployed data sensor via an antenna installed through the perforation in the casing wall, and illustrates the electrical and magnetic fields within a microwave cavity of the data receiver;

FIG. 12 is a plot of the data receiver resonant frequency versus microwave cavity length;

FIG. 13 is a schematic of the data receiver communicating with the data sensor, and includes a block diagram of the data receiver electronics;

FIG. 14 is a block diagram of the data sensor electronics; and

Figure 15:
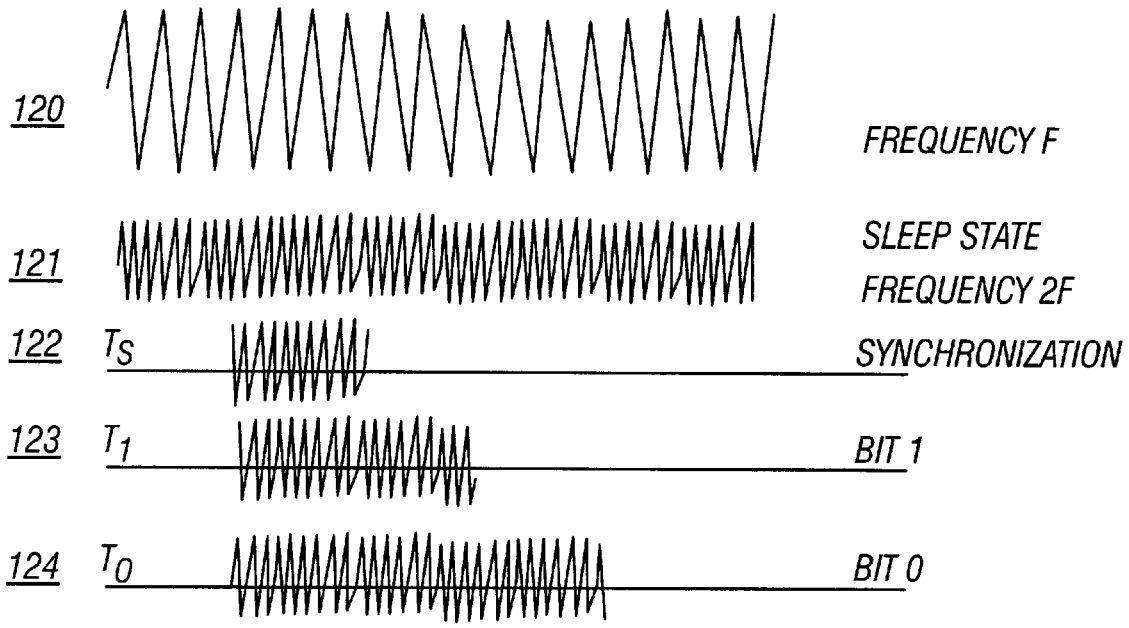

FIG. 15 is a pulse width modulation diagram indicating the timing of data signal transmission between the data sensor and data receiver.

DESCRIPTION OF THE PREFERRED EMBODIMENT(S)

Figure 1:
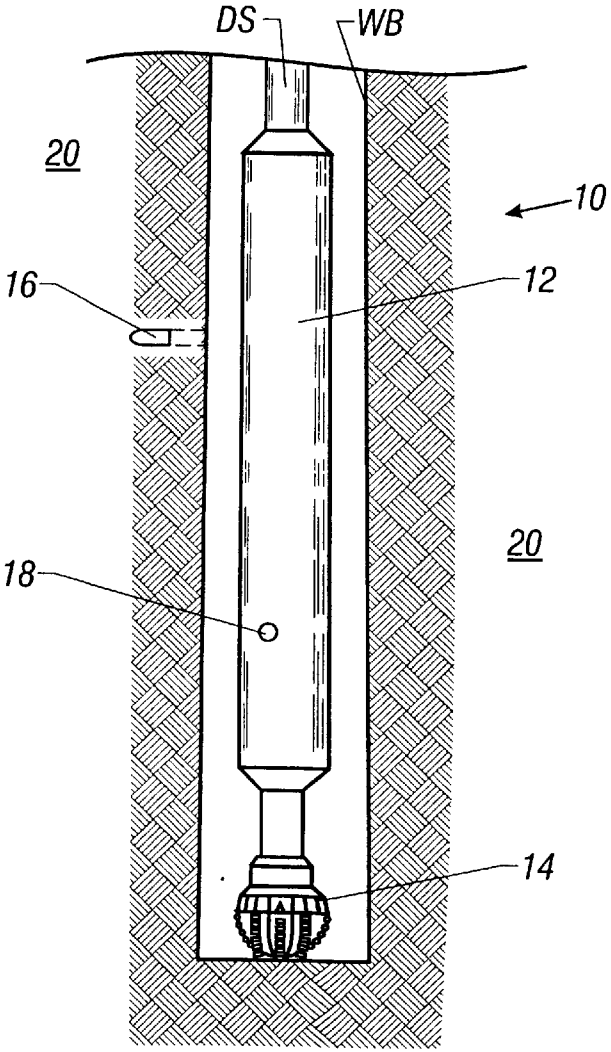

Referring now to the drawings and first to FIG. 1, the present invention relates to the drilling of a wellbore WB with a drill string DS having drill collar 12 and drill bit 14. The drill collar has a plurality of intelligent data sensors 16 which are carried thereon for insertion into the wellbore during drilling operations. As described further below, data sensors 16 have electronic instrumentation and circuitry integrated therein for sensing selected formation parameters, and electronic circuitry for receiving selected command signals and providing data output signals representing the sensed formation parameters.

Each data sensor 16 is adapted for deployment from its retracted or stowed position 18 on drill collar 12 to a remote position within a selected subsurface formation 20 intersected by wellbore WB to sense and transmit data signals representative of various parameters, such as formation pressure, temperature, and permeability, of the selected formation. Thus, when drill collar 12 is positioned by drill string DS at a desired location relative to subsurface formation 20, data sensor 16 is moved to a deployed position within subsurface formation 20 outwardly of wellbore WB under the force of a propellant or a hydraulic ram, or other equivalent force originating at the drill collar and acting on the data sensor. Such forced movement is described in detail in U.S. patent application Ser. No. 09/019,466 in the context of a drill collar having a deployment system.

Deployment of a desired number of such data sensors occurs at various wellbore depths as determined by the desired level of formation data. As long as the wellbore remains open, or uncased, the deployed data sensors may communicate directly with the drill collar, sonde, or wireline tool containing a data receiver, also described in the '466 application, to transmit data indicative of formation parameters to a memory module on the data receiver for temporary storage or directly to the surface via the data receiver.

At some point during the completion of the well, the wellbore is completely cased and typically the casing is cemented in place. From this point, normal communication with deployed data sensors 16 which lie in formation 20 beyond wellbore WB is no longer possible. Thus, communication must be reestablished with the deployed data sensors through the casing wall and cement layer, if the later is present, that line the wellbore.

Figure 2:
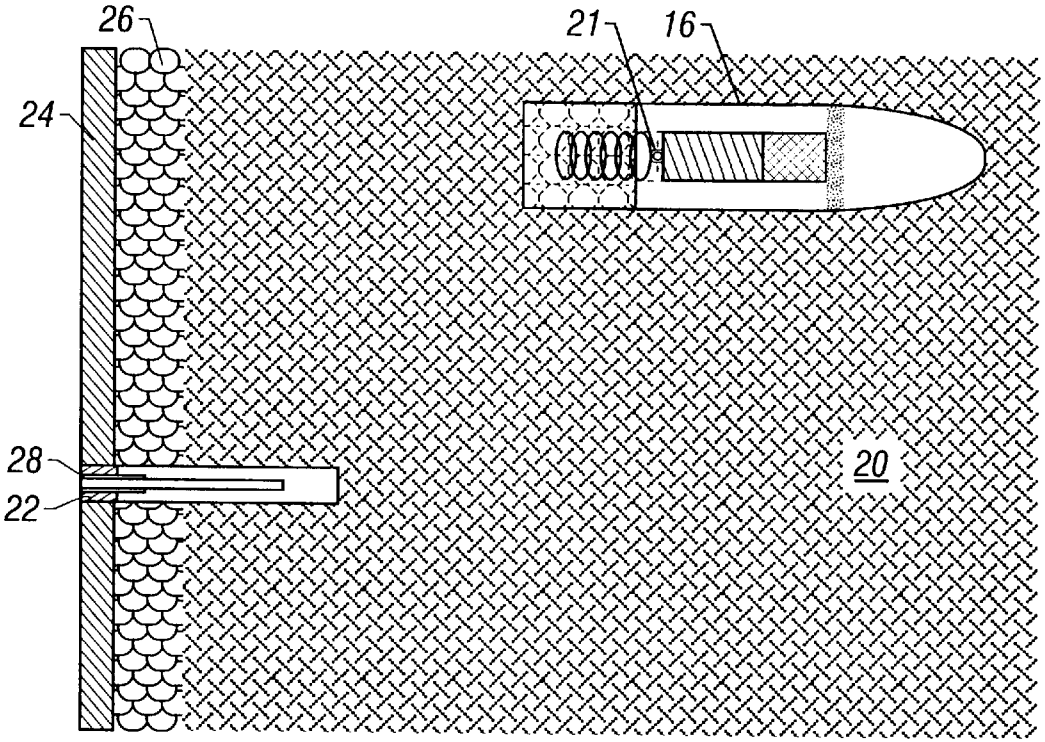

With reference now to FIG. 2, communication is reestablished by creating an opening 22 in casing wall 24 and cement layer 26, and then installing and sealing antenna 28 in opening 22 in the casing wall. However, for optimum communication, antenna 28 should be positioned in a location near or proximate the deployed data sensor. To enable effective electromagnetic communication, it is preferred that the antenna be positioned within 10–15 cm of the respective data sensor or sensors in the formation. Thus, the location of the data sensors relative to the cased wellbore must be identified.

Identification of Data Sensor Location

To permit the location of the data sensors to be identified, the data sensors are equipped with means for transmitting respective identifying signature signals. More specifically, the data sensors are equipped with gamma-ray pip-tag 21 for transmitting a pip-tag signature signal. The pip-tag is a small strip of paper-like material that is saturated with a radioactive solution and positioned within data sensor 16, so as to radiate gamma rays.

The location of each data sensor is then identified through a two-step process. First, the depth of the data sensor is determined using a gamma-ray open hole log, which is created for the wellbore after the deployment of data sensors 16, and the known pip-tag signature signal of the data sensor. The data sensor will be identifiable on the open-hole log because the radioactive emission of pip-tag 21 will cause the local ambient gamma-ray background to be increased in the region of the data sensor. Thus, background gamma-rays will be distinctive on the log at the data sensor location, compared to the formation zones above and below the sensor. This will help to identify the vertical depth and position of the data sensor.

Then, the azimuth of the data sensor relative to the wellbore is determined using a gamma-ray detector and the data sensor's pip-tag signature signal. The azimuth is determined using a collimated gamma-ray detector, as described further below in the context of a multi-functional wireline tool.

Figure 3:
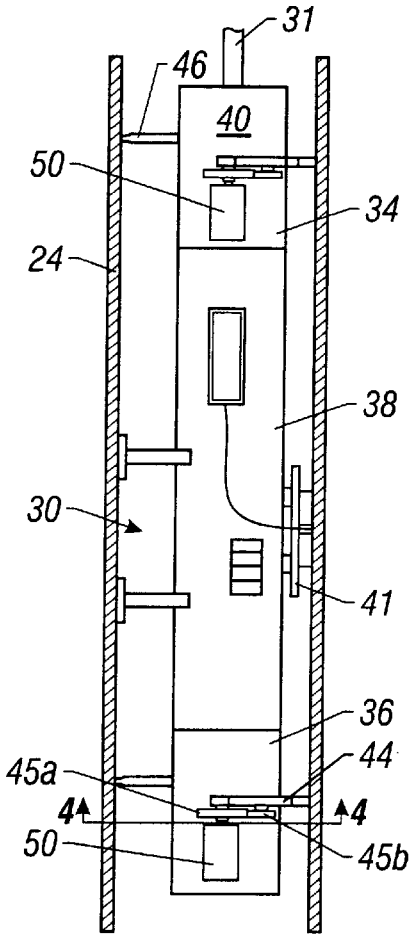
Figure 4:
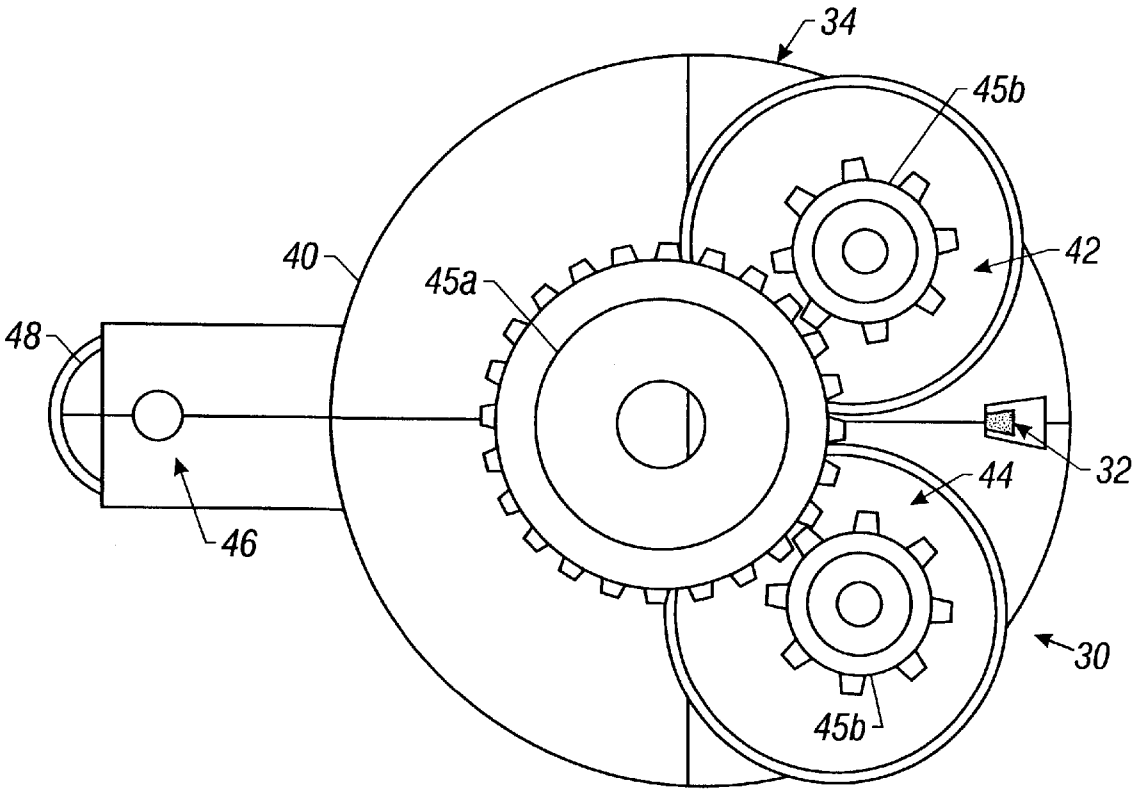

Antenna 28 is preferably installed and sealed in opening 22 in the casing using a wireline tool. The wireline tool, generally referred to as 30 in FIGS. 3 and 4, is a complex apparatus which performs a number of functions, and includes upper and lower rotation tools 34, 36 and an intermediate antenna installation tool 38. Those skilled in the art will appreciate that tool 30 could equally be effective for at least some of its intended purposes as a drill string sub or tool, even though its description herein is limited to a wireline tool embodiment.

Wireline tool 30 is lowered on a wireline or cable 31, the length of which determines the depth of tool 30 in the wellbore. Depth gauges may be used to measure displacement of the cable over a support mechanism, such as a sheave wheel, and thus indicate the depth of the wireline tool in a manner that is well known in the art. In this manner, wireline tool 30 is positioned at the depth of data sensor 16. The depth of wireline tool 30 may also be measured by electrical, nuclear, or other sensors that correlate depth to previous measurements made in the wellbore or to the well casing length. Cable 31 also provides a means for communicating with control and processing equipment positioned at the surface via circuitry carried in the cable.

The wireline tool further includes means, in the form of the upper and lower rotation tools 34, 36, for rotating wireline tool 30 to the identified azimuth, after having been lowered to the proper data sensor depth as determined from the first step of the data sensor location identification process. One embodiment of a simple rotation tool, as illustrated by upper rotation tool 34 in FIGS. 3 and 4, includes cylindrical body 40 with a set of two coplanar drive wheels 42, 44 extending through one side of the body. The drive wheels are pressed against the casing by actuating hydraulic back-up piston 46 in a conventional manner. Thus, extension of hydraulic piston 46 causes pressing wheel 48 to contact the inner casing wall. Because casing 24 is cemented in wellbore WB, and thus fixed to formation 20, continued extension of piston 46 after pressing wheel 48 has contacted the inner casing wall forces drive wheels 42, 44 against the inner casing wall opposite the pressing wheel.

The two drive wheels of each rotation tool are driven, respectively, via a gear train, such as gears 45*a* and 45*b*, by electric servo motor 50. Primary gear 45*a* is connected to the motor output shaft for rotation therewith. The rotating force is transmitted to drive wheels 42, 44 via secondary gears 45*b*, and friction between the drive wheels and the inner casing wall induces wireline tool 30 to rotate as drive wheels 42, 44 "crawl" about the inner wall of casing 24. This driving action is performed by both the upper and lower rotation tools 34, 36 to enable rotation of the entire wireline tool assembly 30 within casing 24 about the longitudinal axis of the casing.

Antenna installation tool 38 includes a means for identifying the azimuth of data sensor 16 relative to wellbore WB in the form of collimated gamma-ray detector 32, thereby providing for the second step of the data sensor location identification process. As indicated previously, collimated gamma-ray detector 32 is useful for detecting the radiation signature of anything placed in its zone of detection. The collimated gamma-ray detector, which is well known in the drilling industry, is equipped with shielding material positioned about a thallium-activated sodium iodide crystal except for a small open area at the detector window. The open area is arcuate, and is narrowly defined for precise identification of the data sensor azimuth.

Figure 5:
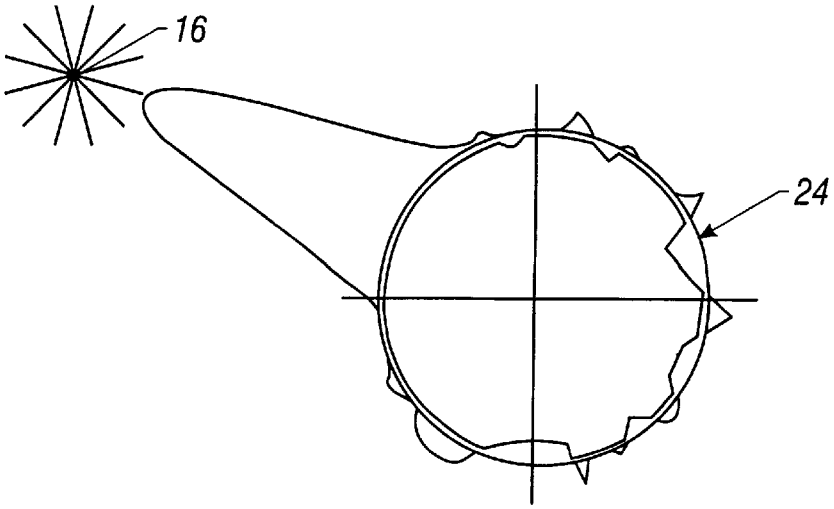

Thus, a rotation of 360 degrees by wireline tool 30, under the output torque of motor 50, within casing 24 reveals a lateral radiation pattern at any particular depth where the wireline tool, or more particularly the collimated gamma-ray detector, is positioned. By positioning the gamma-ray detector at the depth of data sensor 16, the lateral radiation pattern will include the data sensor's gamma-ray signature against a measured baseline. The measured baseline is related to the amount of detected gamma-rays corresponding to the respective local formation background. The pip-tag of each data sensor 16 will give a strong signal on top of this baseline and identify the azimuth at which the data sensor is located, as represented in FIG. 5. In this manner, antenna installation tool 38 can be "pointed" very closely to the data sensor of interest.

Further operation of tool 38 is highlighted by the flow chart sequence of FIG. 7, as will now be described. At this point, wireline tool 30 is positioned at the proper depth and oriented to the proper azimuth, as indicated at block 800 in FIG. 7, and is properly placed for drilling or otherwise creating lateral opening 22 through casing 24 and cement layer 26 proximate the identified data sensor 16. For this purpose, the present invention utilizes a modified version of the formation sampling tool described in U.S. Pat. No. 5,692,565, also assigned to the assignee of the present invention. The '565 patent is incorporated herein by reference in its entirety.

Casing Perforation and Antenna Installation

Figure 6A:
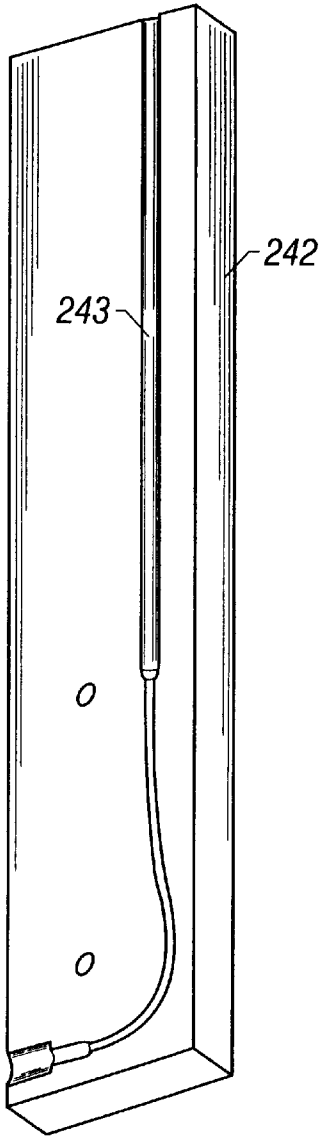
Figure 6:
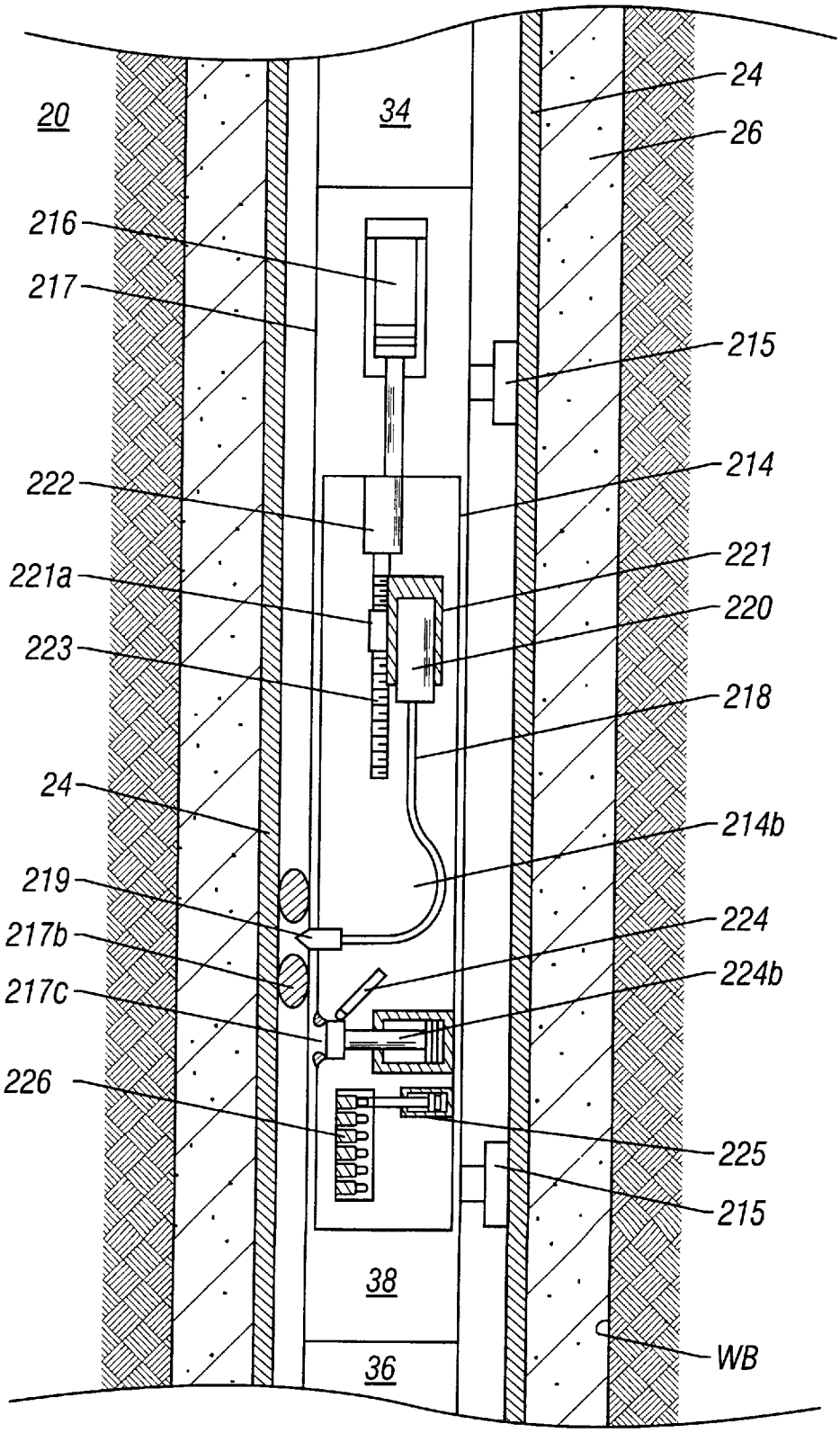

FIG. 6 shows one embodiment of perforating tool 38 for creating the lateral opening in casing 24 and installing an antenna therein. Tool 38 is positioned within wireline tool 30 between upper and lower rotation tools 34, 36, and has a cylindrical body 217 enclosing inner housing 214 and associated components. Anchor pistons 215 are hydraulically actuated in a conventional manner to force tool packer 217*b* against the inner wall of casing 24, forming a pressure-tight seal between antenna installation tool 38 and casing 24 and stabilizing tool 30 as indicated at block 801 in FIG. 7.

FIG. 3 illustrates, schematically, an alternative to packer 217*b*, in the form of hydraulic packer assembly 41, which includes a sealing pad on a support plate movable by hydraulic pistons into sealed engagement with casing 24. Those skilled in the art will appreciate that other equivalent means are equally suited for creating a seal between antenna installation tool 38 and the casing about the area to be perforated.

Referring back to FIG. 6, inner housing 214 is supported for movement within body 217 along the axis of the body by housing translation piston 216, as will be described further below. Housing 214 contains three subsystems: means for perforating the casing; means for testing the pressure seal at the casing; and means for installing an antenna in the perforation. The movement of inner housing 214 via translation piston 216 positions the components of each of inner housing's the three subsystems over the sealed casing perforation.

The first subsystem of inner housing 214 includes flexible shaft 218 conveyed through mating guide plates 242, one of which is shown in FIG. 6A. Drill bit 219 is rotated via flexible shaft 218 by drive motor 220, which is held by motor bracket 221. Motor bracket 221 is attached to translation motor 222 by way of threaded shaft 223 which engages nut 221 a connected to motor bracket 221. Thus, translation motor 222 rotates threaded shaft 223 to move drive motor 220 up and down relative to inner housing 214 and casing 24. Downward movement of drive motor 220 applies a downward force on flexible shaft 218, increasing the penetration rate of bit 219 through casing 24. J-shaped conduit 243 formed in guide plates 242 translates the downward force applied to shaft 218 into a lateral force at bit 219, and also prevents shaft 218 from buckling under the thrust load it applies to the bit. As the bit penetrates the casing, it makes a clean, uniform perforation that is much preferred to that obtainable with shaped charges. The drilling operation is represented by block 802 in FIG. 7. After the casing perforation has been drilled, drill bit 219 is withdrawn by reversing the direction of translation motor 222.

The second subsystem of inner housing 214 relates to the testing of the pressure seal at the casing. For this purpose, housing translation piston 216 is energized from surface control equipment via circuitry passing through cable 31 to shift inner housing 214 upwardly so as to move packer 217*c* about the opening in housing 217. Packer setting piston 224*b* is then actuated to force packer 217*c* against the inner wall of housing 217, forming a sealed passageway between the casing perforation and flowline 224, as indicated at block 803. The formation pressure can then be measured in a conventional manner, and a fluid sample can be obtained if so desired, as indicated at block 804. Once the proper measurements and samples have been taken, piston 224*b* is withdrawn to retract packer 217*c*, as indicated at block 805.

Figure 8:
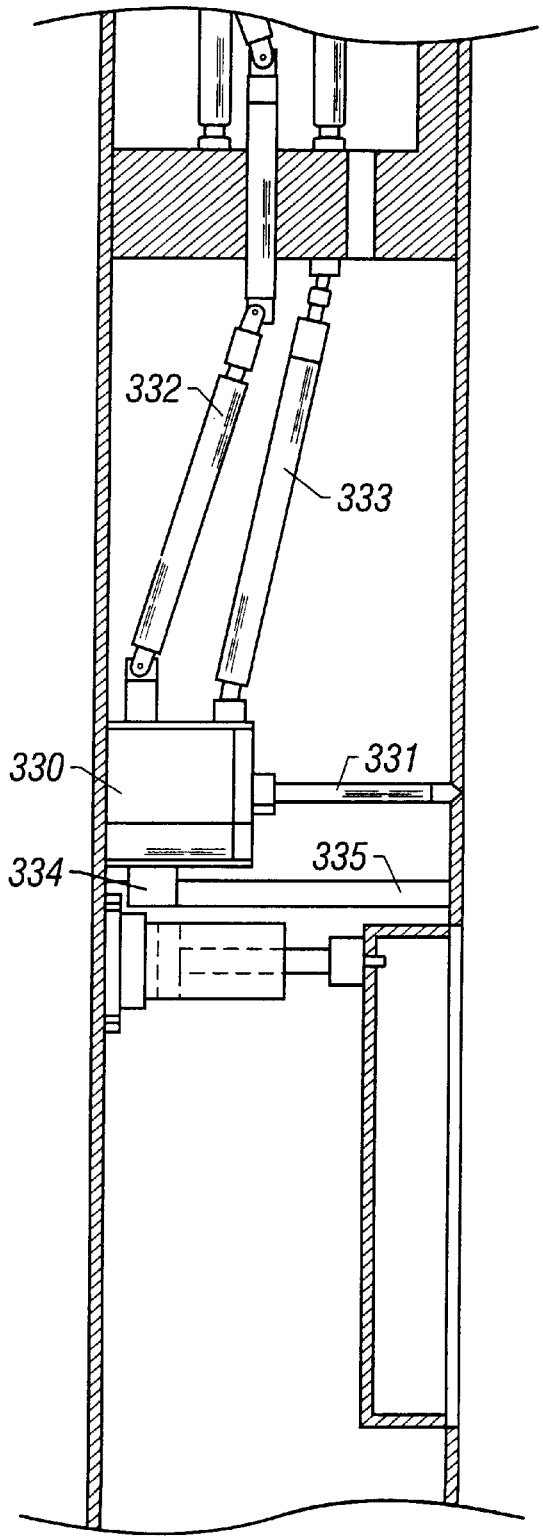

FIG. 8 shows an alternative means for drilling a perforation in the casing, including a right angle gearbox 330 which translates torque provided by jointed drive shaft 332 into torque at drill bit 331. Thrust is applied to bit 331 by a hydraulic piston (not shown) energized by fluid delivered through flowline 333. The hydraulic piston is actuated in a conventional manner to move gearbox 330 in the direction of bit 331 via support member 334 which is adapted for sliding movement along channel 335. Once the casing perforation is completed, gearbox 330 and bit 331 are withdrawn from the perforation using the hydraulic piston.

Housing translation piston 16 is then actuated to shift inner housing 214 upwardly even further to align antenna magazine 226 in position over the casing perforation, as indicated at block 806. Antenna setting piston 225 is then actuated to force one antenna 28 from magazine 226 into the casing perforation. The sequence of setting the antenna is shown more particularly in FIGS. 9A–9C, and 10.

With reference first to FIGS. 9A–9C, antenna 28 includes two secondary components designed for full assembly within the casing perforation: tubular socket 176 and tapered body 177. Tubular socket 176 is formed of an elastomeric material designed to withstand the harsh environment of the wellbore, and contains a cylindrical opening through the trailing end thereof and a small-diameter tapered opening through the leading end thereof The tubular socket is also provided with a trailing lip 178 for limiting the extent of travel by the antenna into the casing perforation, and an intermediate rib 179 between grooved regions for assisting in creating a pressure tight seal at the perforation.

FIG. 10 shows a detailed section of the antenna setting assembly adjacent antenna magazine 226. Setting piston 225 includes outer piston 171 and inner piston 180. Setting the antenna in the casing perforation is a two-stage process. Initially during the setting process, both pistons 171, 180 are actuated to move across cavity 181 and press one antenna 28 into the casing perforation. This action causes both tapered antenna body 177, which is already partially inserted into the opening at the trailing end of tubular socket 176 within magazine 226, and tubular socket 176 to move towards casing perforation 22 as indicated in FIG. 9A. When trailing lip 178 engages the inner wall of casing 24, as shown in FIG. 9B, outer piston 171 stops, but the continued application of hydraulic pressure upon the piston assembly causes inner piston 180 to overcome the force of spring assembly 182 and advance through the cylindrical opening at the trailing end of tubular socket 176. In this manner, tapered body 177 is fully inserted into tubular socket 176, as shown in FIG. 9C.

Tapered antenna body 177 is equipped with elongated antenna pin 177*a*, tapered insulating sleeve 177*b*, and outer insulating layer 177*c*, as shown in FIG. 9C. Antenna pin 177*a* extends beyond the width of casing perforation 22 on each end of the pin to receive data signals from data sensor 16 and communicate the signals to a data receiver positioned in the wellbore, as described in detail below. Insulating sleeve 177*b* is tapered near the leading end of the antenna pin to form an interference wedge-like fit within the tapered opening at the leading end of tubular socket 176, thereby providing a pressure-tight seal at the antenna/perforation interface.

Magazine 226, shown in FIG. 10, stores multiple antennas 28 and feeds the antennas during the installation process. After one antenna 28 is installed in a casing perforation, piston assembly 225 is fully retracted and another antenna is forced upwardly by spring 186 of pusher assembly 183. In this manner, a plurality of antennas can be installed in casing 24.

Figure 9D:
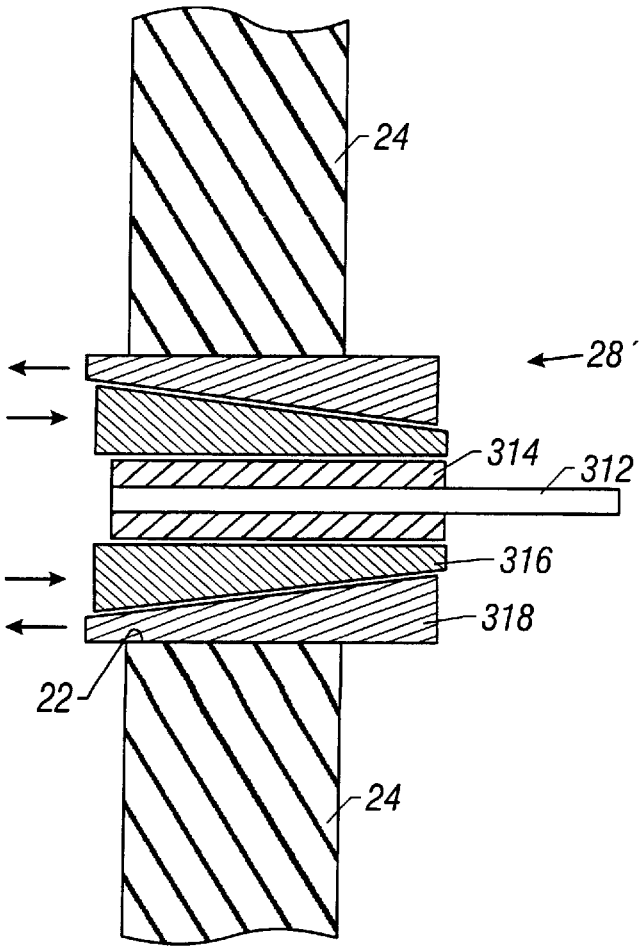

An alternative antenna structure is shown in FIG. 9D. In this embodiment, antenna pin 312 is permanently set in insulating sleeve 314, which in turn is permanently set in setting cone 316. Insulating sleeve 314 is cylindrical in shape, and setting cone 316 has a conical outer surface and a cylindrical bore therein sized for receiving the outer diameter of sleeve 314. Setting sleeve 318 has a conical inner bore therein that is sized to receive the outer conical surface of setting cone 316, and the outer surface of sleeve 318 is slightly tapered so as to facilitate its insertion into casing perforation 22. By the application of opposing forces to cone 316 and sleeve 318, a metal-to-metal interference fit is achieved to seal antenna assembly 310 in perforation 22. The application of force via opposing hydraulically actuated pistons in the direction of the arrows shown in FIG. 9D will force the outer surface of sleeve 318 to expand and the inner surface of cone 316 to contract, resulting in a metal-to-metal seal at perforation or opening 22 for the antenna assembly.

Figure 7:
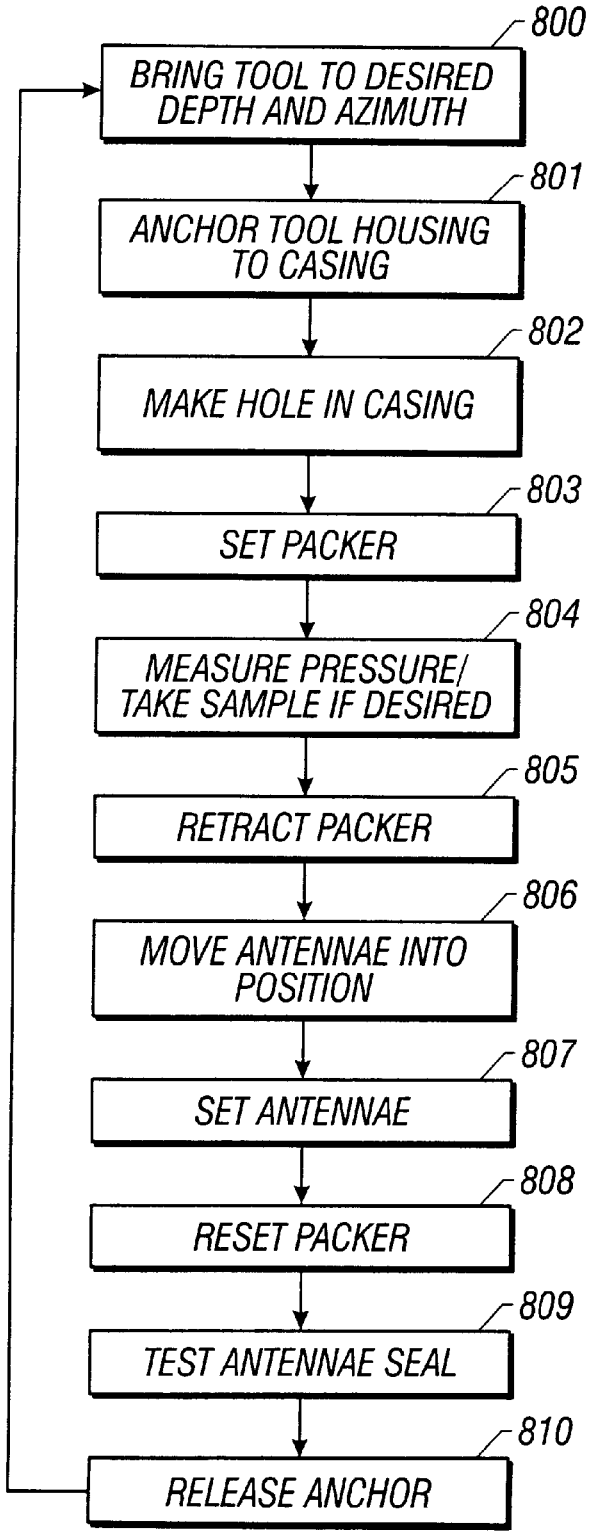

The integrity of the installed antenna, whether it be the configuration of FIGS. 9A–9C, the configuration of FIG. 9D, or some other configuration to which the present invention is equally adaptable, can be tested by again shifting inner housing 214 with translation piston 216 so as to move measurement packer 217*c* over the lateral opening in housing 217 and resetting the packer with piston 224*b*, as indicated at block 808 in FIG. 7. Pressure through flowline 224 can then be monitored for leaks, as indicated at block 809, using a drawdown piston or the like to reduce the flowline pressure. Where a drawdown piston is used, a leak will be indicated by the rise of flowline pressure above the drawdown pressure after the drawdown piston is deactivated. Once pressure testing is complete, anchor pistons 215 are retracted to release tool 38 and wireline tool 30 from the casing wall, as indicated at block 810. At this point, tool 30 can be repositioned in the casing for the installation of other antennas, or removed from the wellbore.

Data Receiver

After antenna 28 is installed and properly sealed in place, a wireline tool containing data receiver 60 is inserted into the cased wellbore for communicating with data sensor 16 via antenna 28. Data receiver 60 includes transmitting and receiving circuitry for transmitting command signals via antenna 28 to intelligent data sensor 16 and receiving formation data signals via the antenna from the intelligent sensor.

More particularly, with reference to FIG. 11, communication between data receiver 60 inside casing 24 and data sensor 16 located outside the casing is achieved in a preferred embodiment via two small loop antennas 14*a* and 14*b*. The antennas are imbedded in antenna assembly 28 which has been placed inside opening 22 by antenna installation tool 38. First antenna loop 14*a* is positioned parallel to the casing axis, and second antenna loop 14*b* is positioned perpendicular to the casing axis. Consequently, first antenna 14*a* is sensitive to magnetic fields perpendicular to the casing axis and second antenna 14*b* is sensitive to magnetic fields parallel to the axis of the casing.

Data sensor 16, also know as a smart bullet, contains in a preferred embodiment two similar loop antennas 15*a* and 15*b* therein. The loop antennas have the same relative orientation to one another as loop antennas 14*a* and 14*b*. However, loop antennas 15*a* and 15*b* are connected in series, as indicated in FIG. 11, so that the combination of these two antennas is sensitive to both directions of the magnetic field radiated by loop antennas 14*a* and 14*b*.

The data receiver in the tool inside the casing utilizes a microwave cavity 62 having a window 64 adapted for close positioning against the inner face of casing wall 24. The radius of curvature of the cavity is identical or very close to the casing inner radius so that a large portion of the window surface area is in contact with the inner casing wall. The casing effectively closes microwave cavity 62, except for drilled opening 22 against which the front of window 64 is positioned. Such positioning can be achieved through the use of components similar to those described above in regard to wireline tool 30, such as the rotation tools, gamma-ray detector, and anchor pistons. (No further description of such data receiver positioning will be provided herein.) Through the alignment of window 64 with perforation 22, energy such as microwave energy can be radiated in and out via the antenna through the opening in the casing, providing a means for two-way communication between sensing microwave cavity 62 and the data sensor antennas 15*a* and 15*b*.

Communication from the microwave cavity is provided at one frequency F corresponding to one specific resonant mode, while communication from the data sensor is achieved at twice the frequency, or 2F. Dimensions of the cavity are chosen to have a resonant frequency close to 2F. Relevant electrical fields 66, 68 and magnetic fields 70, 72 are illustrated in FIG. 11 to help visualize the cavity field patterns. In a preferred embodiment, cylindrical cavity 62 has a radius of 5 cm and a vertical extension of approximately 30 cm. A cylindrical coordinate ($z$, $\rho$, $\phi$) system is used to represent any physical location inside the cavity. The electromagnetic (EM) field excited inside the cavity has an electric field with components $E_z$, $E_\rho$ and $E_\phi$ and a magnetic field with components $H_z$, $H_\rho$ and $H_\phi$.

In transmitting mode, cavity 62 is excited by microwave energy fed from the transmitter oscillator 74 and power amplifier 76 through connection 78, a coaxial line connected to a small electrical dipole located at the top of cavity 62 of data receiver 60.

In receiving mode, microwave energy excited in cavity 62 at a frequency 2F is sensed by the vertical magnetic dipole 80 connected to a receiver amplifier 82 tuned at 2F.

It is a well known fact that microwave cavities have two fundamental modes of resonance. The first one is called transverse magnetic or "TM" ($H_z$=0), and the second mode is called transverse electric or "TE" in short ($E_z$=0). These two modes are therefore orthogonal and can be distinguished not only by frequency discrimination but also by the physical orientation of an electric or magnetic dipole located inside the cavity to either excite or detect them, a feature that the present invention uses to separate signals excited at frequency F from signals excited at 2F. At resonance, the cavity displays a high Q, or dampening loss effect, when the frequency of the EM field inside the cavity is close to the resonant frequency, and a very low Q when the frequency of the EM field inside the cavity is different from the resonant frequency of the cavity, providing additional amplification of each mode and isolation between different modes.

Mathematical expressions for the electrical (E) and magnetic (H) field components of the TM and TE modes are given by the following terms:

For TM Modes:

$$Ez=\lambda_{ni}^2/R^2 J_n(\lambda_{ni}/R\rho)\cos(n\phi)\cos(m\pi z/L)$$

$$E\rho=-m\Pi\lambda_{ni}/LR\, J_n'(\lambda_{ni}/R\rho)\cos(n\phi)\sin(m\pi z/L)$$

$$E\phi=nm\Pi/L\rho J_{ni}(\lambda_{ni}/R\rho)\sin(n\phi)\sin(m\pi z/L)$$

$$Hz=0$$

$$H\rho=jnk/\rho(\epsilon/\mu)^{1/2}J_n(\lambda_{ni}/R\rho)\sin(n\phi)\cos(m\pi z/L)$$

$$H\phi=-jnk\lambda_{ni}/R(\epsilon/\mu)^{1/2}J_n'(\lambda_{ni}/R\rho)\cos(n\phi)\cos(m\pi z/L)$$

with resonant frequency $$F_{TMnim}=c/2((\lambda_{ni}/\pi R)^2+(m/L)^2)^{1/2};$$

and the TE Modes:

$$Ez=0$$

$$E\rho=-jnk/\rho(\mu/\epsilon)^{1/2}J_n(\sigma_{ni}/R\rho)\sin(n\phi)\sin(m\pi z/L)$$

$$E\phi=jk\,\sigma_{ni}/R(\mu/\epsilon)^{1/2}J_n'(\sigma_{ni}/R\rho)\cos(n\phi)\sin(m\pi z/L)$$

$$Hz=\sigma_{ni}^2/R^2J_n(\sigma_{ni}/R\rho)\cos(n\phi)\sin(m\pi z/L)$$

$$H\rho=m\pi\sigma_{ni}/LRJ_n'(\sigma_{ni}/R\rho)\cos(n\phi)\cos(m\pi z/L)$$

$$H\phi=-nm\pi/L\rho J_n(\sigma_{ni}/R\rho)\sin(n\phi)\cos(m\pi z/L)$$

with resonant frequency $$F_{TEnim}=c/2((\sigma_1/\pi R)^2+(m/L)^2)^{1/2};$$

where:

Q=coefficient of dampening;

n, m=integers that characterize the infinite series of resonant frequencies for azimuthal ($\phi$) and vertical (z) components;

i=root order of the equation;

c=speed of light in vacuum;

$\mu$, $\epsilon$=magnetic and dielectric property of the medium inside the cavity, respectively;

F=frequency;

$\omega=2\pi F$;

k=wave number=$(\omega^2\mu\epsilon+i\omega\mu\sigma)^{1/2}$;

R, L=radius and length of cavity, respectively;

$J_n$=Bessel function of order n;

$J_n'=\delta J_n/\delta\rho$;

$\lambda_{ni}$=root of $J_n(\lambda_{ni})=0$; and $\sigma_{ni}$=root of $J_n(\sigma_{ni})=0$.

Dimensions of the cavity (R and L) have been chosen such that:

$$F_{TEnim}=c/2((\sigma_1/\Pi R)^2+(m/L)^2)^{1/2}=2F_{TEnim}=c((\lambda_{ni}/\pi R)^2+(m/L)^2)^{1/2}.$$

One of the solutions for $F_{TMnim}$ is to select the TM mode corresponding to n=0, i=1, m=0, and $\lambda_{01}=2.40483$, which corresponds to the lowest TM frequency mode (lowering frequency lowers cavity dampening loss). This selection produces the following results:

$$Ez=\lambda_{01}^2/R^2J_0(\lambda_{01}/R\rho)$$

$$E\rho=0$$

$$E\phi=0$$

$$Hz=0$$

$$Hp=0$$

$$H\phi=-jk\,\lambda_{01}/R(\epsilon/\mu)^{1/2}J_0'(\lambda_{01}/R\rho)$$

with $$F_{TM010}=c/2\lambda_{01}/\pi R.$$

One solution for $F_{TEnim}$ is to select the TE mode corresponding to n=2, i=1, m=1 and $\sigma_{21}=3.0542$. This selection is orthogonal to the TM010 mode selection above, and produces a frequency for the TE mode which is twice the TM010 frequency. The following results are produced by this TE mode selection:

$$Ez=0$$

$$E\rho=-j2k/\rho(\mu/\epsilon)^{1/2}J_2(\sigma_{21}/R\rho)\sin(2\phi)\sin(\pi z/L)$$

$$E\phi=jk\sigma_{21}/R(\mu/\epsilon)^{1/2}J_2'(\sigma_{21}/R\rho)\cos(2\phi)\sin(\pi z/L)$$

$$Hz=\sigma_{21}^2/R^2J_2(\sigma_{21}/R\,\rho)\cos(2\phi)\sin(\pi z/L)$$

$$H\rho=\Pi\sigma_{21}/LRJ_2'(\sigma_{21}/R\rho)\cos(2\phi)\cos(\pi z/L)$$

$$H\phi=-2\Pi/L\rho J_2(\sigma_{21}/R\rho)\sin(2\phi)\cos(\pi z/L)$$

with $$F_{TE211}=c/2((\sigma_{21}/\pi R)^2+(1/L)^2)^{1/2}.$$

The TM mode can be excited either by a vertical electric dipole (Ez) or a horizontal magnetic dipole (vertical loop H$\phi$), while the TE mode can be excited by a vertical magnetic dipole (horizontal loop Hz).

In FIG. 12, $2F_{TM010}$ and $F_{TE211}$ are plotted as a function of cavity length L for a cavity radius R=5 cm. For L≅28 cm, the TE mode resonates at twice the TM mode, and given the cavity dimensions, the following resonant frequencies are determined:

$$F_{TM010}=494\text{ MHz and }F_{TE211}=988\text{ MHz}.$$

Those of ordinary skill in the related art given the benefit of this disclosure will appreciate that with change in cavity shape, dimensions and filling material, the exact values of the resonant frequencies may differ from those stated above. It should also be understood that the two modes described earlier are just one possible set of resonant modes and that there is, in principle, an infinite set one might choose from. In any case, the preferable frequency range for this invention falls in the 100 MHz to 10 GHz range. It should also be understood that the frequency range could be extended outside this preferred range without departing from the spirit of the present invention.

It is also well known that a cavity can be excited by proper placement of an electrical dipole, magnetic dipole, an aperture (i.e., an insulated slot on a conductive surface) or a combination of these inside the cavity or on the outer surface of the cavity. For instance, coupling loop antennas 14*a* and 14*b* could be replaced by electrical dipoles or by a simple aperture. The data sensor loop antennas could also be replaced by a single or combination of electrical and/or magnetic dipole(s) and/or aperture(s).

FIG. 13 shows a schematic of the present invention, including a block diagram of the data receiver electronics. As stated above, tunable microwave oscillator 74 operates at frequency F to drive microwave power amplifier 76 connected to electrical dipole 78 located near the center of one side of data receiver 60. The dipole is aligned with the z axis to provide maximum coupling to the Ez component of mode TM010 (equation (1) below (Ez is maximum for ρ=0.)).

In order to determine if oscillator frequency F is tuned to the TM010 resonant frequency of cavity 62, horizontal magnetic dipole 88, a small vertical loop sensitive to $H\phi_{TM101}$ (equation (2) below), is connected through a coaxial cable to switch 81 and, via switch 81, to a microwave receiver amplifier 90 tuned at F. The frequency F is adjusted until a maximum signal is received in tuned receiver 90 by means of feedback 83.

$$E_{zTM010}=\lambda_{01}^2/R^2J(\lambda_{01}\ \rho/R) \quad (1)$$

$$H_{\phi TM010}=-jk\lambda_{01}/R(\epsilon/\mu)^{1/2}J_0'(\lambda_{01}\rho/R) \quad (2)$$

$$F=c\lambda_{01}/2\pi R \quad (2)$$

$$H_{ZTE211}=\sigma_{21}^2/R^2J_2(\sigma_{21}\rho/R)\ \sin(2\phi)\ \cos(\pi z/L) \quad (4)$$

$$2F=c/2((\sigma_{21}\rho/R)^2+(1/L)^2)^{1/2} \quad (5)$$

In order to tune the cavity to TE211 mode frequency 2F, a 2F tuning signal is generated in tuner circuit 84 by rectifying a signal at frequency F coming from oscillator 74 through switch 85 by means of a diode similar to diode 19 used with data sensor 16. The output of tuner 84 is connected through a coaxial cable to vertical magnetic dipole 86, a small horizontal loop sensitive to Hz of TM211 (equation (4) above), to excite the TE211 mode at frequency 2F. A similar horizontal magnetic dipole 80, a small horizontal loop also sensitive to Hz of TM211 (equation (4)), is connected to a microwave receiver circuit 82 tuned at 2F. The output of receiver 82 is connected to motor control 92 which drives an electrical motor 94 moving a piston 96 in order to change the length L of the cavity, in a manner that is known for tunable microwave cavities, until a maximum signal is received and the receiver 82 is tuned. It will be apparent to those of ordinary skill in the art that a single loop antenna could replace loop antennas 80 and 86 connected to both circuits 82 and 84.

Once both TM frequency F and TE frequency 2F are tuned, the measurement cycle can begin, assuming that the window 64 of cavity 62 has been positioned in the direction of data sensor 16 and that antenna 28 containing loop antennas 14*a* and 14*b*, or other equivalent means of communication, has been properly installed in casing opening 22. Maximum coupling can be achieved for the TE211 mode if data receiver 60 is positioned such that antenna 28 is approximately level with the vertical center of microwave cavity 62. In this regard, it should be noted that $H\phi_{TM010}$ is independent of z, but $Hz_{TE211}$ is at a maximum for z=L/2.

Formation Data Measurement and Acquisition

The formation data measurement and acquisition sequence is initiated by exciting microwave energy into cavity 62 using oscillator 74, power amplifier 76 and electric dipole 78. The microwave energy is coupled to the data sensor or smart bullet loop antennas 15*a* and 15*b* through coupling loop antennas 14*a* and 14*b* in antenna assembly 28. In this fashion, microwave energy is beamed outside the casing at the frequency F determined by the oscillator frequency and shown on the timing diagram of FIG. 15 at 120. The frequency F can be selected within the range of 100 MHz up to 10 GHz, as described above.

With reference again to FIG. 13, as soon as smart bullet 16 is energized by the transmitted microwave energy, the receiver loop antennas 15*a* and 15*b* located inside the smart bullet radiate back an electromagnetic wave at 2F or twice the original frequency, as indicated at 121 in FIG. 15. A low threshold diode 19 is connected across the loop antennas 15*a*, 15*b*. Under normal conditions, and especially in "sleep" mode, electronic switch 17 is open to minimize power consumption. When loop antennas 15*a*, 15*b* become activated by the transmitted electromagnetic microwave field, a voltage is induced into loop antennas 15*a*, 15*b* and as a result a current flows through the antennas. However, diode 19 only allows current to flow in one direction. This non-linearity eliminates induced current at fundamental frequency F and generates a current with the fundamental frequency of 2F. During this time, the microwave cavity 62 is also used as a receiver and is connected to receiver amplifier 82 which is tuned at 2F.

More specifically, and with reference now to FIG. 14, when a signal is detected by the data sensor detector circuit 100 tuned at 2F which exceeds a fixed threshold, smart bullet data sensor 16 goes from a sleep state to an active state. Its electronics are switched into acquisition and transmission mode and controller 102 is triggered. At that instant following the command of controller 102, pressure information detected by pressure gage 104, or other information detected by suitable detectors, is converted into digital information and stored by the analog-to-digital converter (ADC) memory circuit 106. Controller 102 then triggers the transmission sequence by converting the pressure gage digital information into a serial digital signal inducing the switching on and off of switch 17 by means of a receiver coil control circuit 108.

Various schemes for data transmission are possible. For illustration purposes, a Pulse Width Modulation Transmission scheme is shown in FIG. 15. A transmission sequence starts by sending a synchronization pattern through the switching off and on of switch 17 during a predetermined time, Ts. Bit 1 and 0 correspond to a similar pattern, but with a different "on/off" time sequence (T1 and T0). The signal scattered back by the data sensor at 2F is only emitted when switch 17 is off. As a result, some unique time patterns are received and decoded by the digital decoder 110 in the tool electronics shown on FIG. 13. These patterns are shown under reference numerals 122, 123, and 124 in FIG. 15. Pattern 122 is interpreted as a synchronization command; 123 as Bit 1; and 124 as Bit 0.

After the pressure gage or other digital information has been detected and stored in the data receiver electronics, the tool power transmitter is shut off. The target data sensor is no longer energized and is switched back to its "sleep" mode until the next acquisition is initiated by the data receiver tool. A small battery 112 located inside the data sensor powers the associated electronics during acquisition and transmission.

Those skilled in the art will appreciate that, once remote data sensors, such as the preferred "smart bullet" embodiment described herein, have been deployed into the wellbore formation and have provided data acquisition capabilities through measurements such as pressure measurements while drilling in an open wellbore, it will be desirable to continue using the data sensors after casing has been installed into the wellbore. The invention disclosed herein describes a method and apparatus for communicating with the data sensors behind the casing, permitting such data sensors to be used for continued monitoring of formation parameters such as pressure, temperature, and permeability during production of the well.

It will be further appreciated by those skilled in the art that the most common use of the present invention will likely be within 8½ inch wellbores in association with 6¾ inch drill collars. For optimization and ensured success in the deployment of data sensors 16, several interrelating parameters must be modeled and evaluated. These include: formation penetration resistance versus required formation penetration depth; deployment "gun" system parameters and requirements versus available space in the drill collar; data sensor ("bullet") velocity versus impact deceleration; and others.

For wellbores larger than 8½ inches, the geometrical requirements are less stringent. Larger data sensors can be utilized in the deployment system, particularly at shallower depths where the penetration resistance of the formation is reduced. Thus, it is conceivable that for wellbore sizes above 8½ inches, that data sensors will: be larger in size; accommodate more electrical features; be capable of communication at a greater distance from the wellbore; be capable of performing multiple measurements, such as resistivity, nuclear magnetic resonance probe, accelerometer functions; and be capable of acting as data relay stations for sensors located even further from the wellbore.

However, it is contemplated that future development of miniaturized components will likely reduce or eliminate such limitations related to wellbore size.

In view of the foregoing it is evident that the present invention is well adapted to attain all of the objects hereinabove set forth, together with other objects which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A method for communicating, after casing has been installed in a wellbore, with a data sensor that has been remotely deployed, prior to the installation of casing, into a subsurface formation penetrated by the wellbore, comprising the steps of:

(a) installing an antenna in the casing wall; and (b) inserting a data receiver into the cased wellbore for communicating with the data sensor via the antenna to receive formation data signals sensed and transmitted by the data sensor.

2. A method for communicating, after casing has been installed in a wellbore, with a data sensor that has been remotely deployed, prior to the installation of casing, into a subsurface formation penetrated by the wellbore, comprising the steps of:

(a) identifying the location of the data sensor in the subsurface formation;

(b) creating an opening in the casing wall proximate the data sensor location;

(c) installing an antenna in the casing wall opening; and (d) inserting a data receiver into the cased wellbore proximate the antenna for communicating with the data sensor via the antenna to receive formation data signals sensed and transmitted by the data sensor.

3. The method of claim 2, wherein the data sensor is equipped with means for transmitting a signature signal, and the location of the data sensor is identified by sensing the signature signal.

4. The method of claim 2, wherein the data sensor is equipped with a gamma-ray pip-tag for transmitting a pip-tag signature signal, and the step of identifying the location of the data sensor includes the steps of:

determining the depth of the data sensor using gamma-ray open hole logs and the pip-tag signature signal of the data sensor; and determining the azimuth of the data sensor relative to the wellbore using a gamma-ray detector and the pip-tag signature signal.

5. The method of claim 4, wherein the azimuth of the data sensor is determined using a collimated gamma-ray detector.

6. The method of claim 2, wherein the antenna is installed in the opening in the casing using a wireline tool.

7. The method of claim 6, wherein the data receiver includes a microwave cavity.

8. The method of claim 2, wherein the step of identifying the location of the data sensor comprises the steps of identifying the depth and the azimuth of the data sensor relative to the wellbore.

9. A method for acquiring data from a subsurface earth formation, comprising the steps of:

(a) drilling a wellbore with a drill string having a drill collar and a drill bit, the drill collar having a data sensor adapted for remote positioning within a selected subsurface formation intersected by the wellbore to sense and transmit data signals representative of at least one parameter of the formation;

(b) moving the data sensor from the drill collar into the selected subsurface formation;

(c) installing casing in the wellbore;

(d) creating an opening in the casing wall;

(e) installing an antenna in the casing wall opening; and (f) inserting a data receiver into the cased wellbore for communicating with the data sensor via the antenna to receive formation data signals sensed and transmitted by the data sensor.

10. The method of claim 9, wherein the data receiver is carried on a wireline inserted into the cased wellbore.

11. A method for acquiring data from a subsurface earth formation, comprising the steps of:

(a) drilling a wellbore with a drill string having a drill collar and a drill bit connected thereto, the drill collar having a data sensor adapted for remote positioning within a selected subsurface formation intersected by the wellbore to sense and transmit data signals representative of at least one parameter of the formation;

(b) moving the data sensor from the drill collar into the selected subsurface formation;

(c) installing casing in the wellbore;

(d) identifying the location of the data sensor in the subsurface formation;

(e) creating an opening in the casing wall proximate the data sensor location;

(f) installing an antenna in the casing wall opening; and (g) inserting a data receiver into the cased wellbore proximate the antenna for communicating with the data sensor via the antenna to receive formation data signals sensed and transmitted by the data sensor.

12. The method of claim 11, wherein the data sensor is equipped with means for transmitting a signature signal, and the location of the data sensor is identified by sensing the signature signal.

13. The method of claim 11, wherein the data sensor is equipped with a gamma-ray pip-tag for transmitting a pip-tag signature signal, and the step of identifying the location of the data sensor includes the steps of:

creating a gamma-ray open hole log of the wellbore; determining the depth of the data sensor using the gamma-ray open hole log and the pip-tag signature signal of the data sensor; and determining the azimuth of the data sensor relative to the wellbore using a gamma-ray detector and the pip-tag signature signal.

14. The method of claim 13, wherein the azimuth is determined using a collimated gamma-ray detector.

15. The method of claim 11, wherein the antenna is installed in the opening in the casing using a wireline tool.

16. The method of claim 15, wherein the wireline tool includes:

means for identifying the azimuth of the data sensor relative to the wellbore;

means for rotating the tool to the identified azimuth;

means for creating an opening through the casing at the identified azimuth; and means for installing the antenna into the opening in sealed relation with the casing.

17. The method of claim 11, wherein the data receiver includes a microwave cavity.

18. A method for measuring subsurface earth formation parameters, comprising the steps of:

(a) drilling a wellbore in a subsurface earth formation with a drill string having a drill collar and a drill bit, the drill collar having sensing means movable from a retracted position within the collar to a deployed position within the subsurface earth formation beyond the wellbore, the sensing means having electronic circuitry therein adapted to sense selected formation parameters and provide data output signals representing the sensed formation parameters;

(b) with the drill collar at a desired location relative to a subsurface formation of interest, moving the sensing means from a retracted position within the tool to a deployed position within the subsurface formation of interest outwardly of the wellbore;

(c) installing casing in the wellbore;

(d) identifying the location of the data sensor in the subsurface formation;

(e) creating an opening in the casing wall and installing an antenna therein proximate the data sensor location;

(f) inserting a receiving means into the cased wellbore;

(g) electronically activating the sensing means, causing the sensing means to sense the selected formation parameters and transmit data signals representative of the sensed formation parameters; and (h) receiving the data output signals from the sensing means with the receiving means.

19. An apparatus for acquiring data signals in a cased wellbore from a data sensor that has been remotely deployed, prior to the installation of casing in the wellbore, into a subsurface formation penetrated by the wellbore, comprising:

(a) an antenna adapted for installation in an opening formed in the wall of the casing installed in the wellbore; and (b) a data receiver adapted for insertion into the cased wellbore for communicating with the data sensor via said antenna to receive formation data signals transmitted by the data sensor.

20. The apparatus of claim 19, further comprising:

(c) means for identifying the location of the data sensor in the subsurface formation;

(d) means for creating the casing wall opening proximate the data sensor location; and (e) means for installing said antenna in the casing wall opening.

21. An apparatus for acquiring data from a subsurface earth formation, comprising:

(a) a data sensor adapted for deployment from a drill string within an open-hole wellbore to a remote position within a selected subsurface formation intersected by the wellbore to sense data and transmit data signals representative of various parameters of the formation;

(b) an antenna adapted for installation in an opening formed in the wall of casing cemented in the wellbore;

(c) a data receiver adapted for insertion into the cased wellbore for communicating with said data sensor via said antenna to receive the formation data signals transmitted by said data sensor.

22. The apparatus of claim 21, wherein said data receiver is carried on a wireline inserted into the cased wellbore.

23. An apparatus for acquiring data from a subsurface earth formation, comprising:

(a) a data sensor adapted for remote positioning from a drill collar of a drill string disposed in a wellbore to a deployed position within a selected subsurface formation intersected by the wellbore to sense data and transmit data signals representative of at least one parameter of the formation;

(b) means for identifying the location of the data sensor in the subsurface formation following the installation of casing in the wellbore;

(c) an antenna for communicating with said data sensor;

(d) means for installing said antenna in an opening in the casing wall proximate the data sensor location.

24. The apparatus of claim 23, wherein said data sensor is equipped with means for transmitting a signature signal which is utilized by said location identifying means.

25. The apparatus of claim 23, wherein said data sensor is equipped with a gamma-ray pip-tag for transmitting a pip-tag signature signal, and said location identifying means includes:

a gamma-ray open hole log for determining the depth of said data sensor; and a gamma-ray detector for determining the azimuth of said data sensor relative to the wellbore.

26. The apparatus of claim 25, wherein the gamma-ray detector is a collimated gamma-ray detector.

27. The apparatus of claim 23, wherein said antenna installing means includes a wireline tool.

28. The apparatus of claim 27, wherein said wireline tool includes:

means for identifying the azimuth of the data sensor relative to the wellbore;

means for rotating the wireline tool to the identified azimuth;

means for creating an opening through the casing and cement at the identified azimuth; and means for installing said antenna into the opening in the casing.

29. The apparatus of claim 23, further comprising a data receiver adapted for positioning in the cased wellbore proximate said antenna for communicating with said data sensor via said antenna to receive the formation data signals transmitted by said data sensor.

30. A wireline tool for establishing communication in a cased wellbore with a data sensor that has been remotely deployed, prior to the installation of casing in the wellbore, into a subsurface formation penetrated by the wellbore, the wireline tool comprising:

means for identifying the azimuth of the data sensor relative to the wellbore;

means for rotating the wireline tool to the identified azimuth;

means for creating an opening through the casing wall at the identified azimuth; and means for installing an antenna in the opening in the casing wall for communicating with the data sensor.

31. An apparatus for acquiring selected data from a subsurface formation intersected by a wellbore, comprising:

(a) a sensor adapted for deployment from a location on a drill collar in a drill string positioned in the wellbore during drilling operations to a remote location within the subsurface formation penetrated by the wellbore, said sensor having electronic circuitry for sensing selected data from the formation, and electronic circuitry for transmitting and receiving selected signals;

(b) an antenna adapted for installation in a lateral opening formed in the wall of casing installed in the wellbore proximate said sensor;

(c) a data receiver having transmitting and receiving circuitry for transmitting an activation signal to said sensor via said antenna and receiving formation data signals from said sensor via said antenna.

32. An apparatus for acquiring selected data from a subsurface formation intersected by a wellbore during drilling of the wellbore, comprising:

(a) a drill collar adapted for connection in a drill string and having a sensor receptacle;

(b) a remote sensor located within the sensor receptacle of said drill collar and having electronic circuitry for sensing the selected data, for receiving command signals, and for transmitting data signals representative of the sensed formation data, said remote sensor being adapted for deployment from the sensor receptacle to a location within the subsurface formation beyond the wellbore;

(c) an antenna for communication with said remote sensor after said sensor has been deployed into the subsurface formation;

(d) means adapted for carrying said antenna into the wellbore after the wellbore has been cased, for drilling an opening in the casing proximate said remote sensor, and for installing said antenna into the drilled opening in the casing wall; and (e) a data receiver adapted for insertion into the wellbore and having electronic circuitry for transmitting signals via said antenna after installation of said antenna in the casing wall to activate said remote sensor and for receiving formation data signals via said antenna from said remote sensor.

33. The apparatus of claim 32, wherein:

the transmitting and receiving circuitry of said data receiver is adapted for transmitting command signals at a frequency F and for receiving data signals at a frequency 2F; and the receiving and transmitting circuitry of said remote sensor is adapted for receiving command signals at a frequency F and for transmitting data signals at a frequency 2F.

34. The apparatus of claim 32, wherein:

said remote intelligent sensor includes an electronic memory circuit for acquiring formation data over a period of time; and the data sensing circuitry of said remote sensor includes means for inputting formation data into the electronic memory circuit, and a coil control circuit for receiving the output of said electronic memory circuit for activating the receiving and transmitting circuitry of said remote sensor for transmitting signals representative of the sensed formation data from the deployed location of said remote sensor to said data receiver.

35. An apparatus for establishing communication with a data sensor that lies in a subsurface formation penetrated by a cased wellbore, comprising:

means for identifying the location of the data sensor in the formation;

means for creating a perforation in the casing proximate the identified data sensor location;

an antenna for communicating with the data sensor; and means for inserting said antenna into the casing perforation in the casing.

36. The apparatus of claim 35, further comprising a housing adapted for movement through the cased wellbore and in which said location identifying means, said perforation creating means, said antenna, and said antenna inserting means are carried.

37. The apparatus of claim 36, wherein said housing is suspended on a wireline that can raise and lower said housing in the wellbore.

38. The apparatus of claim 36, wherein the data sensor emits a distinct radiation signal, and said location identifying means comprises:

open hole radiation logs for determining the depth of the data sensor; and a radiation detector carried within said housing for determining the azimuth of the data sensor relative to the wellbore.

39. The apparatus of claim 36, wherein said housing has a lateral opening therein, and said apparatus further comprises means for rotating said housing relative to the cased wellbore to position the opening in said housing substantially at the azimuth of the data sensor.

40. The apparatus of claim 39, wherein said perforation creating means comprises:

means for securing said housing at a substantially fixed location in the cased wellbore;

a drilling means carried within said housing for creating a perforation in the casing of the wellbore; and means carried within said housing for actuating said drilling means.

41. The apparatus of claim 40, wherein the drilling means comprises:

a drill bit adapted for perforating the casing;

means for rotating the drill bit relative to the casing to create the perforation therein; and means connected to said housing for applying force to the drill bit transverse the wellbore so as to drive the drill bit through the casing as it is rotated by the rotating means.

42. The apparatus of claim 36, wherein said antenna inserting means comprises:

means carried within said housing for storing a plurality of antennas adapted for communication with the data sensor;

means for moving one antenna into position for insertion into the perforation; and means for forcing the one antenna through the opening in said housing into the perforation in the casing.

* * * * *